US008938078B2

(12) United States Patent
Meyer

(10) Patent No.: US 8,938,078 B2
(45) Date of Patent: Jan. 20, 2015

(54) METHOD AND SYSTEM FOR ENHANCING SOUND

(75) Inventor: James E. Meyer, Lancaster, PA (US)

(73) Assignee: ConcertSonics, LLC, Lititz, PA (US)

( * ) Notice: Subject to any disclaimer, the term of this patent is extended or adjusted under 35 U.S.C. 154(b) by 443 days.

(21) Appl. No.: 13/269,536

(22) Filed: Oct. 7, 2011

(65) Prior Publication Data

US 2012/0087507 A1 Apr. 12, 2012

Related U.S. Application Data

(60) Provisional application No. 61/390,817, filed on Oct. 7, 2010.

(51) Int. Cl.

| | |
|---|---|
| ***H04R 27/00*** | (2006.01) |
| *H04R 5/033* | (2006.01) |
| *H04R 5/04* | (2006.01) |

(52) U.S. Cl.

CPC ..... *H04R 27/00* (2013.01); *H04R 5/033* (2013.01); *H04R 5/04* (2013.01); *H04R 2227/007* (2013.01); *H04R 2420/07* (2013.01)

USPC ..... 381/82; 381/56; 381/79; 381/80; 381/74

(58) Field of Classification Search

CPC ..... H04B 5/00; H04B 3/00; H04R 27/00; H04R 29/00; H04R 1/10

USPC ..... 381/77, 82, 56, 79–80, 74

See application file for complete search history.

(56) References Cited

U.S. PATENT DOCUMENTS

| | | | |
|---|---|---|---|
| 2,567,431 | A | 9/1951 | Halstead |
| 3,235,804 | A | 2/1966 | McIntosh |
| 3,906,160 | A | 9/1975 | Nakamura et al. |
| 4,165,487 | A | 8/1979 | Corderman |
| 4,610,024 | A | 9/1986 | Schulhof |
| 4,618,987 | A | 10/1986 | Steinke et al. |

(Continued)

FOREIGN PATENT DOCUMENTS

| | | |
|---|---|---|
| JP | 55-077295 | 6/1980 |
| JP | 57-202138 | 12/1982 |
| WO | 92/05673 A1 | 4/1992 |

OTHER PUBLICATIONS

International Application No. PCT/US2011/055483, International Search Report, dated Jan. 25, 2012, 2 pages.

(Continued)

*Primary Examiner* — Disler Paul
(74) *Attorney, Agent, or Firm* — Blank Rome LLP

(57) ABSTRACT

A method of enhancing audio sound. The method includes sensing an acoustic signal using a microphone in an electronic device. The acoustic signal is emitted in response to a primary sound signal and transmitted as a sound wave through a space. The method further includes receiving, using an antenna in the electronic device, a wireless signal encoded with the primary sound signal. An impulse response for the space is estimated based on the sensed acoustic signal and the primary sound signal encoded within the received wireless signal. A delay between the sensed acoustic signal and the primary sound signal encoded within the received wireless signal is calculated based on the estimated impulse response. The primary sound signal encoded within the received wireless signal is delayed using the calculated delay and reproduced to enhance the acoustic signal heard by a user of the electronic device.

38 Claims, 7 Drawing Sheets

(56) References Cited

U.S. PATENT DOCUMENTS

| | | | | |
|---|---|---|---|---|
| 4,829,500 | A | 5/1989 | Saunders | |
| 4,899,388 | A | 2/1990 | Mlodzikowski | |
| 4,993,074 | A | 2/1991 | Carroll | |
| 5,058,169 | A | 10/1991 | Temmer | |
| 5,131,051 | A | 7/1992 | Kishinaga et al. | |
| 5,432,858 | A | 7/1995 | Clair, Jr. et al. | |
| 5,506,910 | A | 4/1996 | Miller et al. | |
| 5,619,582 | A * | 4/1997 | Oltman et al. | 381/82 |
| 5,668,884 | A * | 9/1997 | Clair et al. | 381/82 |
| 5,757,932 | A | 5/1998 | Lindemann et al. | |
| 5,778,082 | A * | 7/1998 | Chu et al. | 381/92 |
| 5,822,440 | A | 10/1998 | Oltman et al. | |
| 6,167,417 | A | 12/2000 | Parra et al. | |
| RE38,405 | E | 1/2004 | Clair, Jr. et al. | |
| RE48,305 | | 1/2004 | Claire, Jr. et al. | |
| 6,691,073 | B1 | 2/2004 | Erten et al. | |
| 6,826,284 | B1 * | 11/2004 | Benesty et al. | 381/92 |
| 7,043,031 | B2 | 5/2006 | Klayman et al. | |
| 7,046,999 | B2 | 5/2006 | Wu et al. | |
| 7,092,529 | B2 | 8/2006 | Yu et al. | |
| 7,095,866 | B1 | 8/2006 | Drakoulis et al. | |
| 7,099,821 | B2 | 8/2006 | Visser et al. | |
| 7,110,552 | B1 | 9/2006 | Saliterman | |
| 7,206,417 | B2 | 4/2007 | Nathan | |
| 7,343,016 | B2 | 3/2008 | Kim | |
| 7,366,662 | B2 | 4/2008 | Visser et al. | |
| 7,392,102 | B2 | 6/2008 | Sullivan et al. | |
| 7,577,261 | B2 | 8/2009 | Liu et al. | |
| 7,653,344 | B1 | 1/2010 | Feldman et al. | |
| 7,657,224 | B2 | 2/2010 | Goldberg et al. | |
| 7,680,652 | B2 | 3/2010 | Giesbrecht et al. | |
| 7,742,740 | B2 | 6/2010 | Goldberg et al. | |
| 7,742,832 | B1 | 6/2010 | Feldman et al. | |
| 7,881,482 | B2 | 2/2011 | Christoph | |
| 7,995,770 | B1 * | 8/2011 | Simon | 381/82 |
| 7,999,622 | B2 | 8/2011 | Galton et al. | |
| 2006/0126861 | A1 | 6/2006 | Saliterman | |
| 2007/0086597 | A1 | 4/2007 | Kino | |
| 2007/0116316 | A1 | 5/2007 | Goldberg | |
| 2007/0160224 | A1 | 7/2007 | Nathan | |
| 2008/0123869 | A1 | 5/2008 | Huang | |
| 2008/0152152 | A1 * | 6/2008 | Kimura | 381/17 |
| 2009/0010443 | A1 | 1/2009 | Ahnert et al. | |
| 2009/0086990 | A1 | 4/2009 | Christoph | |
| 2009/0220104 | A1 | 9/2009 | Allison | |
| 2009/0276067 | A1 | 11/2009 | Forrester et al. | |
| 2009/0298431 | A1 | 12/2009 | Rasmussen | |
| 2010/0002893 | A1 | 1/2010 | Theverapperuma et al. | |
| 2010/0022189 | A1 | 1/2010 | Coker et al. | |
| 2010/0027806 | A1 | 2/2010 | Heine et al. | |
| 2010/0082491 | A1 | 4/2010 | Rosenblatt et al. | |
| 2010/0305725 | A1 | 12/2010 | Brannmark et al. | |
| 2010/0310084 | A1 | 12/2010 | Hersbach | |
| 2011/0129098 | A1 | 6/2011 | Delano et al. | |
| 2011/0172793 | A1 | 7/2011 | Richards et al. | |
| 2012/0063610 | A1 * | 3/2012 | Kaulberg et al. | 381/71.1 |

OTHER PUBLICATIONS

International Application No. PCT/US2011/055483, Written Opinion, dated Jan. 25, 2012, 5 pages.

* cited by examiner

METHOD AND SYSTEM FOR ENHANCING SOUND

CROSS REFERENCE TO RELATED APPLICATION

This application claims the benefit of U.S. Provisional Application No. 61/390,817, entitled "Method and System for Enhancing Sound" and filed Oct. 7, 2010, the contents of which application are incorporated herein by reference.

FIELD OF THE INVENTION

This invention relates to a method of enhancing sound heard by a listener and, more specifically, to methods and systems for enhancing the quality of a primary acoustic signal heard by an audience member (also referred to herein as a "listener") at a performance by adding a supplemental acoustic signal in close proximity to his or her ears to go along with the primary acoustic signal which typically originates near the main performance area.

BACKGROUND OF THE INVENTION

Audio events, such as concerts, speeches, etc., are often held in large venues, such as stadiums, parks, arenas, etc. Delivering audio to listeners at such events is challenging because of the size of the venues and their acoustical characteristics.

In large venues, speakers broadcasting the audio may be arrayed in desirable locations to deliver audio to the audience members. Other venues may simply arrange banks of speakers on or near the stage. Despite careful placement of speakers, the quality of sound heard by the audience members may not as good as desired.

Numerous conventional devices and systems for enhancing the quality of sound heard by an audience member at an audio event have been proposed. For example, U.S. Pat. No. 7,110,552 to Saliterman describes a system designed to collect acoustic signals created at an event, wirelessly transmit them, and reproduce them to a plurality of listeners at the event who are wearing headphones, but the system makes no attempt to compensate for the propagation delay of sound.

U.S. Pat. Nos. 5,619,582 and 5,822,440 both to Oltman et al., as well as U.S. Pat. No. 7,995,770 to Simon, describe systems that do add a wirelessly-transmitted supplemental acoustic signal at a listener's ears via headphones, where the supplemental signal is also delayed to compensate for the propagation delay of the primary acoustic signal that also reaches the listener's ears directly.

SUMMARY OF THE INVENTION

According to an exemplary aspect of the present invention, there is provided a method of enhancing an acoustic signal. The method includes sensing an acoustic signal using a microphone in an electronic device. The acoustic signal is emitted in response to a primary sound signal and transmitted as a sound wave through a space. The method further includes receiving, using an antenna in the electronic device, a wireless signal encoded with the primary sound signal. An impulse response for the space is estimated based on the sensed acoustic signal and the primary sound signal encoded within the received wireless signal. A delay between the sensed acoustic signal and the primary sound signal encoded within the received wireless signal is calculated based on the estimated impulse response. The primary sound signal encoded within the received wireless signal is delayed using the calculated delay and reproduced to enhance the acoustic signal heard by a user of the electronic device.

According to another exemplary aspect of the present invention, there is provided a device for enhancing an acoustic signal. The device comprises a microphone, an antenna, a processor, a delay line, and an output. The microphone is configured for sensing an acoustic signal, the acoustic signal having been emitted in response to a primary sound signal and transmitted as a sound wave through a space. The antenna is configured for receiving a wireless signal encoded with the primary sound signal. The processor is configured for estimating an impulse response for the space based on the sensed acoustic signal and the primary sound signal encoded within the received wireless signal. The processor is further configured for calculating a delay between the sensed acoustic signal and the primary sound signal encoded within the received wireless signal based on the estimated impulse response. The delay line delays the primary sound signal encoded within the received wireless signal using the calculated delay. The delayed primary sound signal is output via the output.

According to yet another exemplary aspect of the present invention, there is provided a computer-readable medium programmed with software instructions. When executed by a processor, the software instructions cause the processor to estimate an impulse response for a space based on a sensed acoustic signal and a primary sound signal encoded within a received wireless signal. The software instructions further cause the processor to calculate a delay between the sensed acoustic signal and the primary sound signal encoded within the received wireless signal based on the estimated impulse response and to output the calculated delay for delaying the primary sound signal encoded within the received wireless signal.

BRIEF DESCRIPTION OF THE DRAWINGS

For the purpose of illustration, there are shown in the drawings certain embodiments of the present invention. In the drawings, like numerals indicate like elements throughout. It should be understood, however, that the invention is not limited to the precise arrangements, dimensions, and instruments shown. In the drawings.

DETAILED DESCRIPTION

Figure 1:
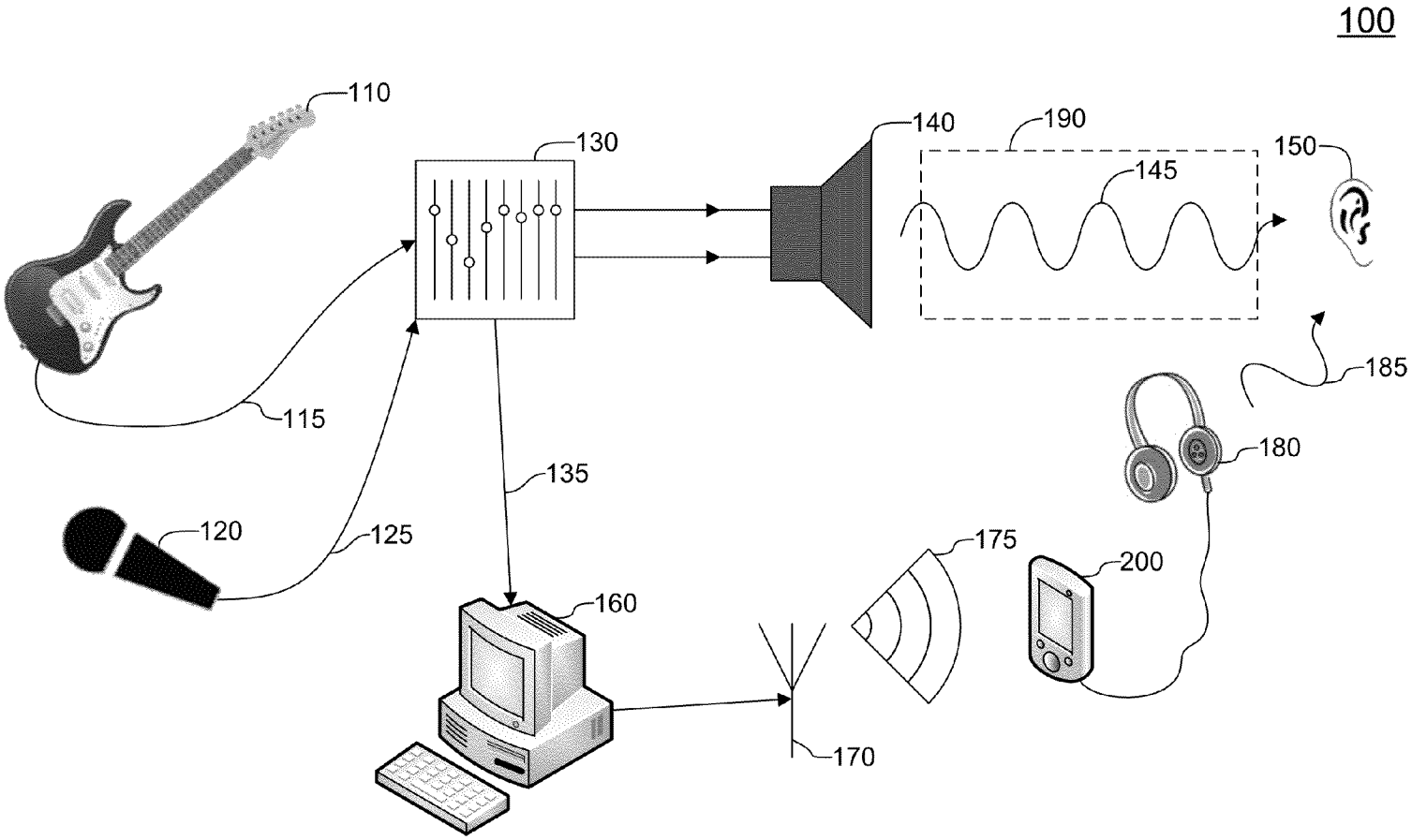
FIG. 1 illustrates an exemplary system for delivering audio to a listener, the system comprising one or more sources of audio, a sound mixer for mixing and processing the one or more sources of audio, one or more primary speakers, and a sound enhancement device for enhancing audio broadcast by the one or more primary speakers, in accordance with an exemplary embodiment of the present invention.

The conventional devices and systems for enhancing the quality of sound described above suffer from various disadvantages. Saliterman's system is limited to use at events where the original acoustic signals collected are not loud enough to reach each listener's ears via direct acoustical propagation through the air. Otherwise, the direct acoustic sound, which likely suffers significant propagation delay, and the reproduced sound in the headphones, which is not delayed, will be perceived negatively when combined at the listener's ears.

The systems described by Oltman et al. and by Simon discussed above rely on measuring and/or calculating the physical distance from the primary acoustic source to the listener using wireless location measurement methods. From that physical distance, the systems calculate an estimate of the propagation delay using some assumed value for the propagation speed of sound through air. Such wireless location measurement methods can be difficult and expensive to implement in practice, and their accuracy can be poor. It is not uncommon for wireless location measurement methods to only be accurate to within a radius of about 10 feet of the object being located, which could yield an error in the calculated propagation delay of roughly +/−9 msec just from this one source of error.

The location of the primary acoustic source where the primary sound originates is also important to the accuracy of the types of systems described by Oltman et al. and Simon. A typical large music concert sound system can contain 50 or more individual speakers, each positioned and oriented in a specific way to accurately reproduce sound over a large audience area with a sufficient sound level. The aforementioned location-based systems should somehow measure and store the location of every one of these speakers and try to determine which speaker or speakers are broadcasting the majority of the sound which a given listener is hearing. It is not a matter of simply picking the speaker which the listener is physically closest to because the majority of sound reinforcement speakers are not omnidirectional. They intentionally have a high directivity, especially at frequencies near 3 kHz where the human ear is most sensitive, so that the speakers' sound can be aimed at specific listening areas to try to reduce sound-degrading reflections and echoes off objects such as walls, ceilings, glass windows, etc. outside the intended listening area.

In these location-based systems, it is possible that a listener could be located only 30 feet from a speaker which is aimed away from the listener, with a speaker 100 feet away from the listener aimed right at the listener providing the majority of the direct sound perceived by the listener. Under such conditions, the propagation delay from the speaker 100 feet away is the proper delay to use to compensate the supplemental acoustic signal being played in the headphones. To properly work, such location-based systems would need to have knowledge about the position of all the speakers in the primary sound system, their acoustic properties, and their current orientation. Using this information, the location-based systems would then need to apply a complex algorithm to determine which of the speakers are providing the majority of the sound a given listener is hearing.

It is also true that the propagation speed of sound in air is influenced by the atmospheric conditions of the air, especially the temperature of the air. At an outdoor event, it is not uncommon for the temperature of the air to change throughout the duration of the event, such as when the sun goes down. Such location-based inventions may measure the atmospheric conditions at a point within the venue and use that information to calculate a more accurate estimate of the propagation speed of sound in air within the venue at times throughout the event. However, that speed of sound may only be truly accurate right at the position where the atmospheric conditions are sensed, and such systems typically assume that the speed of sound is uniform throughout the air within the venue, which may not be the case. A large group of human bodies at an event typically generates a lot of heat and moisture which gets passed to the surrounding air, especially the air local to those bodies which the primary acoustic sound must propagate through. Thus, the propagation speed of the primary sound may not be constant throughout its entire distance of travel, resulting in further errors in the calculated propagation delay time.

In view of the foregoing, it is desirable to directly measure the propagation delay of the primary acoustic sound that is perceived by the listener, eliminating all such errors related to measuring physical locations or distances when trying to estimate the propagation delay.

Referring now to FIG. 1, there is illustrated a system, generally designated as 100, for enhancing sound heard by a listener, in accordance with an exemplary embodiment of the present invention. The system 100 comprises one or more sources of sound. Such sources of sound may include one or more instruments, such as a guitar 110, keyboard (not illustrated), etc., and one or more vocalists, whose vocals are sensed by one or more microphones 120. Discussion below of the system 100 is made with reference to the guitar 110 and the microphone 120, although it is to be understood that the system 100 may be used with any number of instruments and microphones. Further, it is to be understood that the system 100 may be used with any sources of sound which are desired to be produced or reproduced for an audience.

The system 100 further comprises an audio mixer 130, which receives the sound generated by the guitar 110 and sensed by the microphone 120 as electrical audio signals transmitted over respective cabling 115 and 125. The audio mixer 130 mixes the audio signals and changes the level, timbre, and dynamics, as desired and as known in the art. The audio mixer 130 outputs a processed audio signal (primary sound signal) to a primary sound system 140, which broadcasts the processed audio signal (primary sound signal) as an audible acoustic signal 145 (also referred to herein as "the sound 145") through an acoustic space 190, which acoustic signal 145 is heard by an audience member or listener 150 located in the acoustic space 190. This constitutes a first path by which sound is delivered to the listener 150. In an exemplary embodiment, the primary sound system 140 is one or more audio speakers.

In a large venue, the listener 150 may be more than 100 feet away from the primary sound system 140. Because of the great distance from the primary sound system 140, the audible acoustic signal 145 may suffer from a number of distortions and degradations when travelling through the acoustic space 190, which distortions and degradations may reduce the enjoyment of the performance by the audience member 150.

To improve the quality of the audio heard by the audience member 150, the sound enhancement system 100 further comprises a sound enhancement device 200, which outputs an enhanced audio signal to a pair of headphones 180 worn by the audience member 150. The headphones 180 reproduce the enhanced audio signal as an enhanced or supplemental audible acoustic signal 185, which is synchronized to the audible acoustic signal 145 by the sound enhancement device 200.

It is contemplated that the sound enhancement device 200 may used in various applications. It is to be understood that the system 100 is an example of a system in which the sound enhancement device 200 may be used. In an exemplary embodiment of the system 100, the sources of sound 110 and 120 may be live sources of sound, and the primary sound system 140 may be primary speakers located near the sources of sound 110 and 120. The system 100 may be a live music concert in an arena, at a stadium, at a large outdoor space, etc., having a theater, stage, or podium, on which the primary sound system 140 (primary speakers) is located.

In another exemplary embodiment of the system 100, the sources of sound 110 and 120 may be reproduced sound, such as previously recorded sound that is reproduced using the primary sound system 140. In such a system 100, the audio mixer 130 may not be present but other means for amplifying and equalizing the reproduced sounds may be used. An example of this exemplary embodiment of the system 100 is a theater having a large audience space 190 through which the acoustic signal 145 is transmitted. The theater may be a movie theater or a theater having a live performance with prerecorded sound. In yet another exemplary embodiment of the system 100, the sources of sound 110 and 120 may be a combination of reproduced sound and live sound and may alternate between reproduced sound and live sound, such as may happen at a live concert during intermission.

To provide such enhanced acoustic signal 185 to the audience member 150, the sound enhancement system 100 delivers the processed audio signal (primary sound signal) to the audience member 150 via a second path. Specifically, the audio mixer 130 outputs the processed audio signal (primary sound signal) to a computer 160 via a connection 135. The computer 160 receives the processed audio signal (primary sound signal), encodes it, and rebroadcasts the encoded, processed audio signal (primary sound signal) wirelessly via an antenna 170 as a wireless signal 175. In an exemplary embodiment, the antenna 170 is a Wi-Fi transmitter.

It is to be understood that in each exemplary embodiment of the system 100, the primary sound signal encoded within the wireless signal 175 should be significantly similar to the primary sound signals driving the primary sound system 140. However, it is to be understood that it is contemplated that there might be slight differences between the primary sound signal provided to the primary sound system 140 and the primary sound signal provided to the computer 160.

It is also to be understood that the computer 160, though illustrated in FIG. 1 as a personal computer, is not limited to being a personal computer. Any electronic device capable of receiving the processed audio signal and encoding it for transmission via the antenna 170 is contemplated. It is also to be understood that the antenna 170 is not limited to being a Wi-Fi transmitter. For example, it may be a WiMAX transmitter. Further, in an exemplary alternative embodiment, the computer 160 in conjunction with the antenna 170 may be a conventional frequency modulation (FM) radio transmitter or any other form of wireless transmitter/encoder capable of transmitting the primary sound signal.

The audio signal is transmitted wirelessly by the antenna 170 to provide the signal 175 over a wide area, such as over the acoustic space 190 through which the acoustic signal 145 travels. Doing so allows the listener 150 to freely move about the acoustic space 190. Furthermore, it allows the system 100 to be used by any number of listeners. Thus, although the system 100 is illustrated with a listener 150 and description herein is made with reference to the listener 150, it is to be understood that any number of listeners in the acoustic space 190 may each use a sound enhancement device 200 to provide an enhanced or supplemental acoustic signal 185.

The wireless signal 175 and the audible acoustic signal 145 are not synchronized when they reach the user 150. The audible acoustic signal 145 lags the wireless signal 175, primarily because the propagation delay of sound through air is much higher than the propagation delay of radio waves through the same space 190 in which the air is contained. Although there may be more points adding to delay between the source 110, 120 and the antenna 170 than between the source 110, 120 and the primary sound system 140, in practice for any listener, such as the listener 150, located more than a few feet away from the primary sound system 140, the delay caused by the propagation of the audible acoustic signal 145 through the air is greater than all other delays. Thus, the audible acoustic signal 145 lags the wireless signal 175.

The sound enhancement device 200 receives the wireless signal 175. Using a delay-searching algorithm, the sound enhancement device 200 calculates a delay for the encoded sound (the encoded primary sound signal), delays the encoded sound by that calculated delay, and plays it via the headphones 180 as the supplemental acoustic signal 185. The supplemental acoustic signal 185 is thus synchronized to the audible acoustic signal 145 at the listener 150 so that the listener's audio experience is enhanced. Because the sound signal encoded within the wireless signal 175 suffers minimal degradation due to transmission, the supplemental acoustic signal 185 enhances the audible acoustic signal 145 heard by the listener 150.

Figure 2:
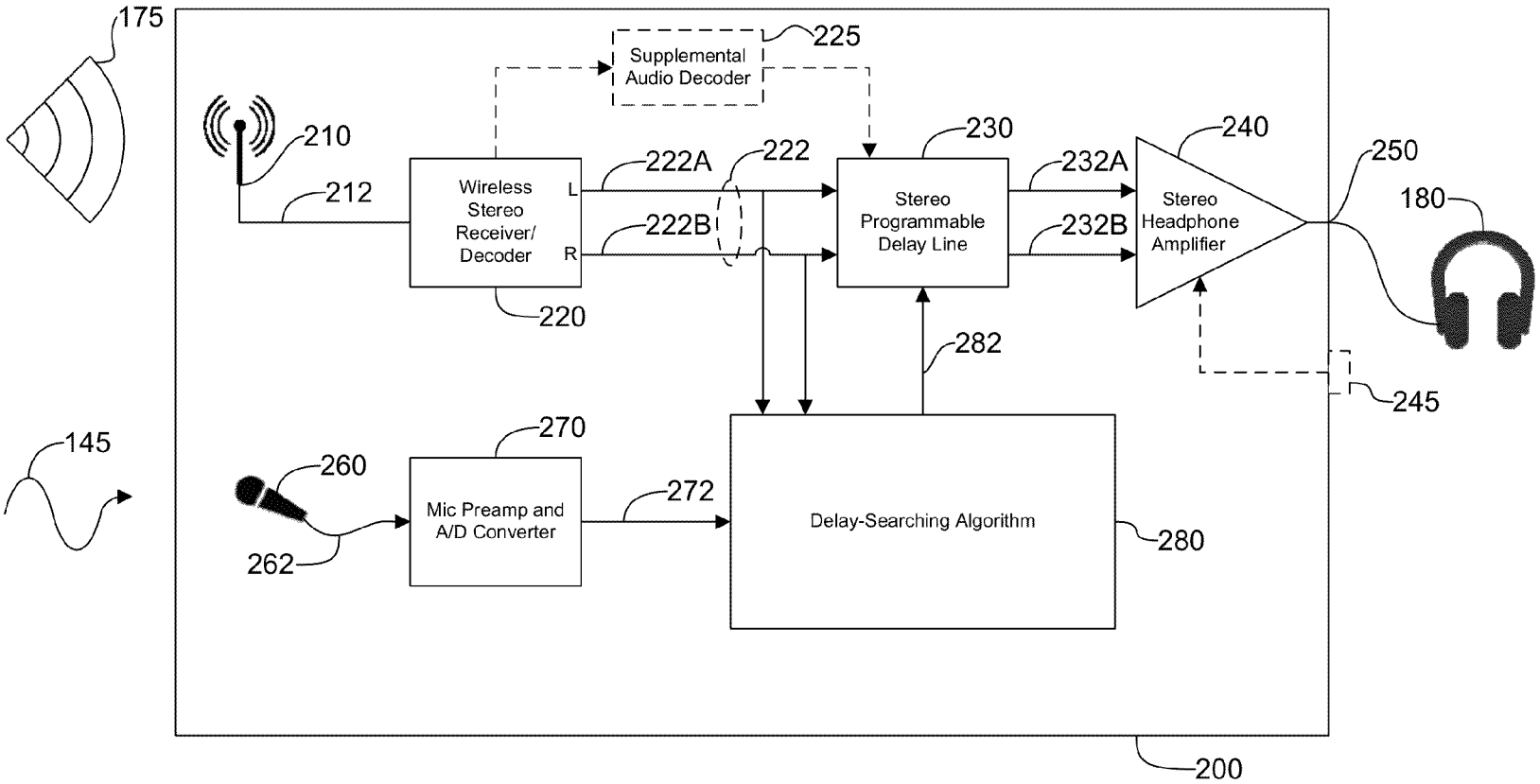
FIG. 2 illustrates an exemplary embodiment of the sound enhancement device of FIG. 1, the sound enhancement device programmed with a delay-searching algorithm that calculates a delay to be applied against a dry audio signal to synchronize it with a wet audio signal, in accordance with an exemplary embodiment of the present invention.

Illustrated in FIG. 2 is an exemplary embodiment of the sound enhancement device 200, in accordance with an exemplary embodiment of the present invention. The device 200 comprises an antenna 210 for receiving the wireless signal 175. As described above with reference to FIG. 1, the wireless signal 175 comprises an encoded primary sound signal, which herein is also referred to as a "dry signal." The source of this dry signal is the primary sound signal provided to the primary sound system 140 and to the computer 160. Thus, the processed audio signal and the primary sound signal are also referred to herein as a "dry signal."

For purposes of discussion herein, the term, "dry signal," refers to a reference audio signal which has no extra processing applied to it that would change how it is audibly perceived. In contrast, the term, "wet signal," refers herein to an audio (acoustic) signal originating at one or more sound system speakers at a performance event (for example, located near the stage in a concert hall, the stage or pulpit in a house of worship, the projection screen in a movie theater, the performance area at a sporting event, or anywhere that speakers are used to amplify a voice or music), which audio (acoustic) signal is designed to be heard by many people at the same time.

The antenna 210 outputs the received wireless signal 175 as an electrical signal 212, which is input into a wireless stereo receiver/decoder 220. The wireless stereo receiver/decoder 220 decodes the electrical signal 212 to produce a decoded dry signal 222 and outputs the decoded dry signal 222. In the exemplary embodiment of the sound enhancement device 200 illustrated in FIG. 2, the dry signal 222 is a stereo signal comprising a left signal or channel 222A and a right signal or channel 222B. It is to be understood that the dry signal 222 may contain any number of channels, e.g., one, two, or three or more. As is described below, the sound enhancement device 200 uses the dry signal 222 to supplement a primary acoustic signal, such as the audible acoustic signal 145, heard by the user, e.g., the listener 150, of the sound enhancement device 100.

The device 200 further comprises a microphone 260 for receiving the audible acoustic signal 145. It is intended that the device 200, and thus its microphone 260, be located in close proximity to the listener 150 so that the acoustic signal 145 sensed by the microphone 260 has received substantially the same propagation delay as the acoustic signal 145 sensed by the ears of the listener 150. In an exemplary embodiment, the sound enhancement device 200 is a small portable device held by the listener 150's hands or worn by the listener 150, e.g., clipped to the listener 150's waist, etc.

The microphone 260 outputs the received audible acoustic signal 145 as an electrical signal 262, which herein below is referred to as the wet signal 262. The wet signal 262 is the electrical representation of the audible acoustic signal 145 having propagated through the air 190 to the listener 150's ears (and is thus delayed by the propagation speed of sound in air at roughly 0.9 milliseconds per foot of travel) and is picked up by the microphone 262 on the sound enhancement device 200. The wet signal 262 includes the audible acoustic signal 145 received directly from the primary sound system 140 and also typically many reflections or echoes, e.g., from walls, pillars, or other objects in the environment surrounding the primary sound system 140 and the listener 150, these reflections or echoes contributing to the signal 262 being termed "wet."

A transfer function ("TF") is a frequency-domain characterization of how a signal is altered as it is transferred from the input of a system to its output. An impulse response ("IR") is a time waveform which characterizes the response of a system from its input to its output if a perfect impulse was applied at the input (the bang of a pistol being an acoustic approximation to an impulse). A system's IR and TF are equivalent representations of the system and can be converted back and forth between each other using Fourier transform mathematical processes.

In the case of the sound enhancement device 200, the IR/TF of interest is that from the dry signal 175 to the wet signal 145 or, more specifically, from the dry signal 222 to the wet signal 262. Such IR/TF defines how the primary sound system 140 and the acoustics of the venue 190 alter the original signal provided to the primary sound system 140. The differences between the wet and dry signals 262 and 222 include:

(a) the non-constant amplitude-versus-frequency response and the non-constant directivity response of the one or more speakers which make up the primary sound system 140;

(b) high-frequency loss due to air absorption as sound travels a far distance;

(c) reverberations from the acoustic environment 190 surrounding the primary sound system 140 and listener 150;

(d) any sounds which did not originate from the primary sound system 140 (crowd noise, etc.);

(e) the delay added to the acoustic signal 145 due to the speed of sound as the signal 145 propagates through the air; and (f) the non-constant amplitude-versus-frequency response and non-omnidirectional response of the microphone 260 in the sound enhancement device 200.

Using methods and processing described herein, the sound enhancement device 200 reduces the sound-degrading effects of (a) through (d) above by adding a supplemental acoustic signal, while also compensating the supplemental acoustic signal for (e), which cannot be changed. Specifically, using the dry signal 222, or more specifically the left and right dry signals 222A and 222B, and the wet signal 262, the sound enhancement device 200 calculates a delay between the wet signal 262 and the dry signal 222.

The sound enhancement device 200 further comprises a preamplifier and A/D converter 270, which receives the wet signal 262, amplifies it, and converts it to a digital signal 272. Thus, the wet signal 262 is an analog wet signal 262, and the signal 272 is a digital wet signal 272.

The digital wet signal 272 is provided to a delay-searching algorithm 280, which also receives the dry signal 222 as the left and right dry signals 222A and 222B. The delay-searching algorithm 280 calculates a delay 282 between the wet signal 272 and the dry signal 222 and outputs the calculated delay 282 to a stereo programmable delay line 230.

In addition to being provided to the delay-searching algorithm, the left and right wet signals 222A and 222B are provided as inputs to the stereo programmable delay line 230, which delays the left and right dry signals 222A and 222B depending on the calculated delay 282 received from the delay-searching algorithm 280. The stereo programmable delay line 230 outputs the delayed signals as signals 232A and 232B, which are passed to a stereo headphone amplifier 240, which includes a D/A converter, which converts the signals 232A and 232B to an analog signal. The amplifier 240 amplifies the analog signal and outputs it via an output 250 to the headphones 180. In an exemplary embodiment, the headphone 180 are digital headphones, and the stereo headphone amplifier 240 outputs the signal 232A and 232B to the headphones.

In an exemplary embodiment, the sound enhancement device 200 is a personal or portable device, such as a personal data assistant (PDA) or "smartphone." It is to be understood that the sound enhancement device 200 is not so limited. In other exemplary embodiments, the personal sound enhancement device 200 may be a tablet personal computer, a notebook or subnotebook computer, a handheld computer, or a dedicated hardware device designed just for this invention, or etc.

In an exemplary embodiment, the amplifier 240 is user adjustable to adjust the volume of the signal at the output 250. For example, the sound enhancement device 200 may further include a volume control 245, which controls the gain of the stereo headphone amplifier 240 to adjust the volume of the enhanced acoustic signal 185. Adjustability of the volume of the supplemental acoustic signal 185 allows the listener 150 to blend the acoustic signal 145 and the supplemental acoustic signal 185 for best personal preference.

Various styles of headphones 180 are contemplated for use with the sound enhancement device 200. The style of the headphones 180 used can vary depending on the preference of the listener 150. At a very loud rock concert, for example, the listener 150 may choose to wear sealed headphones (either over-the-ear or in-ear) in order to block out as much of the loud and reverberant sound as possible coming from the primary sound system 140. The listener 150 could then adjust the level of the headphone amplifier 240 in the sound enhancement device 200 to effectively yield a lower sound pressure level (SPL) at his or her eardrums. Even though such headphones 180 are sealed to the listener's head, lower frequency sounds from the primary sound system 140 may still reach the listener's eardrums. Thus, compensating for the propagation delay in the sound 145 may still be desirable for the listener 150. Alternatively, the listener 150 may instead choose to wear non-sealed headphones, which allow more of the sound 145 from the primary sound system 140 to reach his or her eardrums. Non-sealed headphones may also allow the listener 150 to hear someone nearby talking, thereby allowing the listener 150 to engage in conversation with that person while still enjoying the benefits of the sound enhancement device 200.

Figure 3:
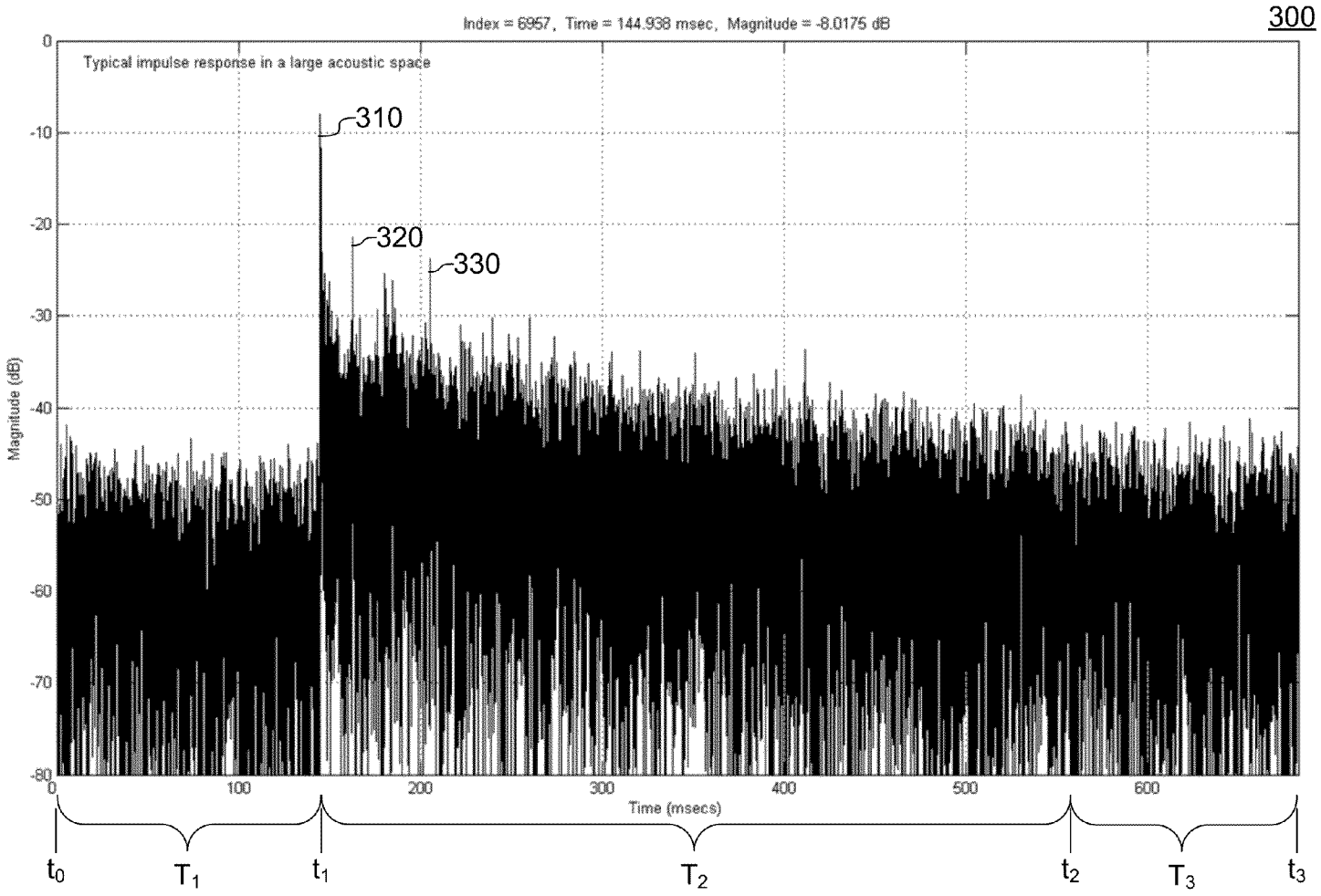
FIG. 3 illustrates an exemplary logarithmic plot of a desired impulse response of a large acoustic space, in accordance with an exemplary embodiment of the present invention.

An exemplary IR 300 is illustrated in FIG. 3 as a plot of logarithmic magnitude versus time estimated from measurements made by a measurement system, in accordance with an exemplary embodiment of the present invention. This exemplary IR 300 is typical of a fairly accurate estimation for an IR of any large acoustic space 190, through which the sound 145 may travel. The time axis of the IR 300 is broken into three time periods, $T_1$ (spanning from time $t_0$ to time $t_1$), $T_2$ (spanning from time $t_1$ to time $t_2$), and $T_3$ (spanning from time $t_2$ to time $t_3$).

In FIG. 3, the time period $T_1$ is characterized by a very low signal level (measurement noise). The length of the time period $T_1$ corresponds to the propagation delay ($t_1$-$t_0$) of the acoustic signal 145. The time period $T_2$ is characterized by a sharp transition at time $t_1$ to a very high peak 310 in the IR 300, which corresponds to the arrival of the acoustic signal 145. Following the peak 310, there is a period of decay in the IR 300 in the time period $T_2$ interspersed with peaks 320 and 330 corresponding to strong reflections in the acoustic space 190. By time $t_2$, the reverberations have decayed into the measurement system's noise floor. The time period $T_3$ is characterized by measurement noise after the reflections in the acoustic space 190 have decayed into the measurement system's noise floor.

The time $t_1$ of the highest magnitude peak in the estimated IR 300 is often the correct value of the propagation delay time sought and can be used as a first guess in the delay-searching algorithm 280. However, there are several reasons why it may be difficult to get an accurate IR, and those are discussed below.

Figure 4A:
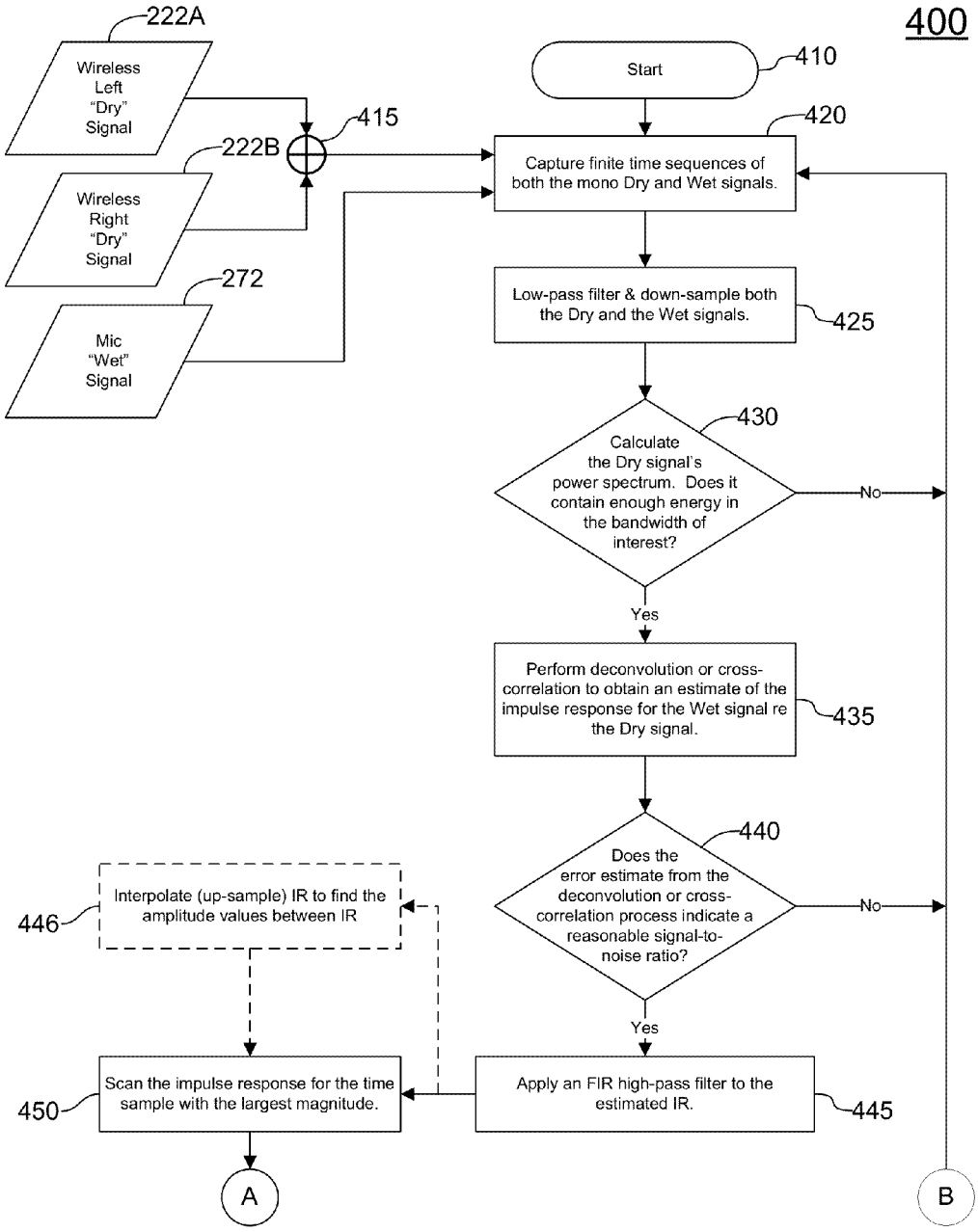
FIGS. 4A and 4B illustrate an exemplary embodiment of the delay-searching algorithm of FIG. 2, in accordance with an exemplary embodiment of the present invention.
Figure 4B:
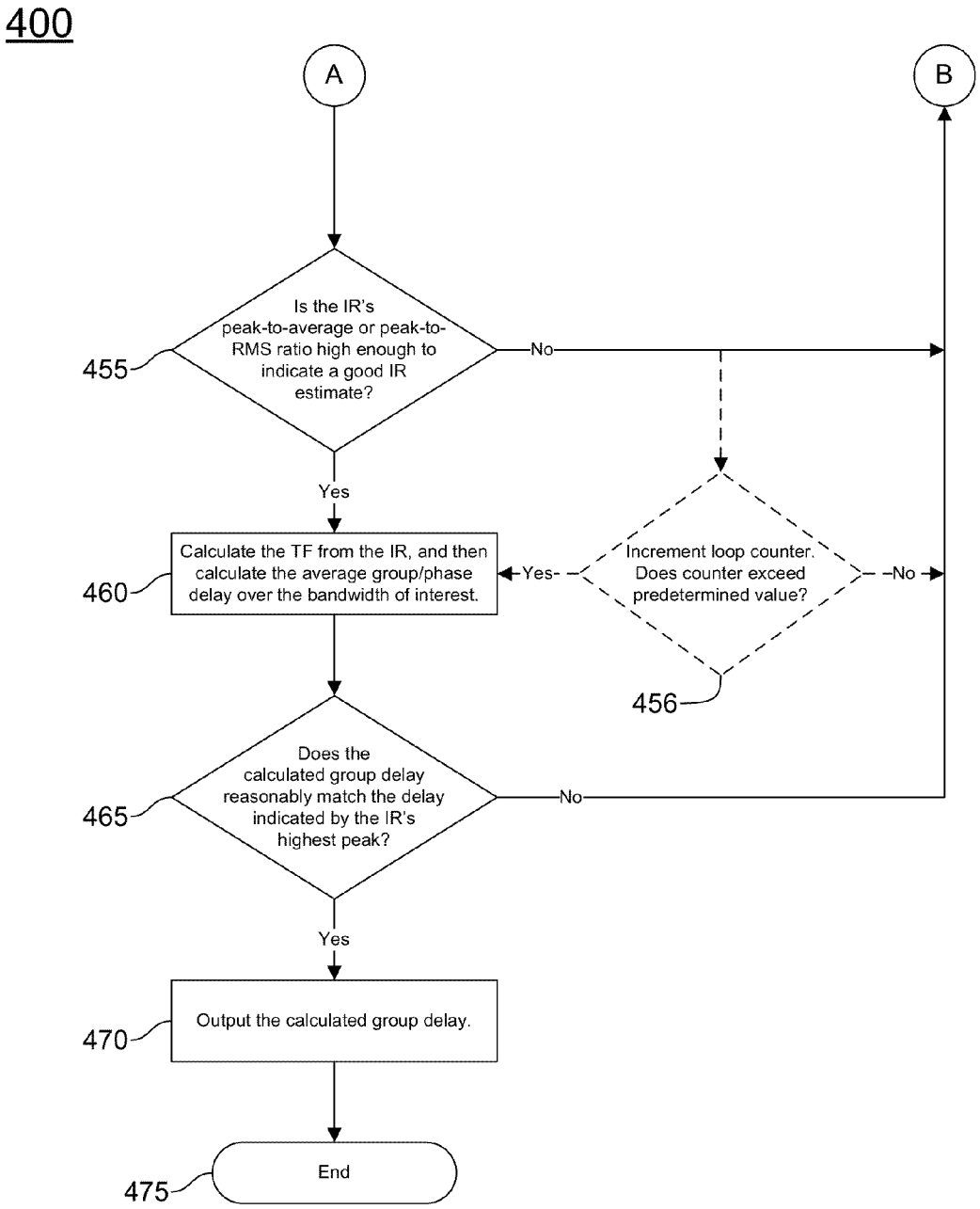

Referring now to FIGS. 4A and 4B, there is illustrated a delay-searching method 400 executed by the personal sound enhancement device 200 to calculate the delay between the wet signal 272 and the dry signal 222, in accordance with an exemplary embodiment of the present invention. The delay-searching method 400 is employed by the delay-searching algorithm 280 in the sound enhancement device 200 to calculate the delay 282. FIGS. 4A and 4B illustrate certain steps 410 through 475 of the delay-searching method 400. It is to be understood that the delay-searching method 400 may include additional exemplary steps, such as the steps 446 and/or 456, as described below, or certain of the step 410 through 475 may perform additional or alternative processing, as described below.

The delay-searching method 400 begins in a Step 410. The delay-searching method 400 may begin upon command of the listener 150 of the sound enhancement device 200. For example, the listener 150 may open a software application in the sound enhancement device 200, which software application executes the delay-searching algorithm 280 to initiate the delay-searching method 400. When such software application is opened, the delay-searching method 400 may start automatically or may start upon selection by the listener 150. In another exemplary embodiment, the delay-searching algorithm 280 may begin upon remote activation, such as by the computer 160.

Following initiation of the delay-searching method 400 in the Step 410, the method 400 receives the left and right dry signals 222A and 222B and sums and captures them as a mono dry signal, Step 415. The method 400 then captures a finite time sequence of the mono dry signal and receives and captures a finite time sequence of the wet signal 272, Step 420. The mono dry sequence and the wet sequence are then buffered in the Step 420. Desirably, the beginning of each sequence corresponds to the same receive time using some reference time base in the sound enhancement device 200.

However, the beginning of each sequence may not correspond to the same receive time. Thus, in an exemplary embodiment, in the Step 420, the method 400 provides a time stamp to each finite time sequence indicating when each time sequence was captured. The time stamps provide the method 400 with an ability to reference any calculated delays to the time sequences against any delays already built into the captured finite time sequences resulting from the sequences being captured at different times due to processing or buffering lags. In an alternative exemplary embodiment, in the Step 420, the method 400 determines a time difference between the beginnings of the dry and wet sequences so their relative lags due to differing processing or capture lags can be accounted for later when adjusting the stereo programmable delay line 230.

The lengths of these captured sequences are determined based on the maximum propagation delay time expected for the listener 150 based on the farthest distance the listener 150 may be from the primary sound system 140, and also based on how quickly it is desired that the method 400 compute the delay time 282. The delay search range is desirably longer than the expected maximum propagation delay time in order to be guaranteed that the correct delay time can be found, but the computation power required in the sound enhancement device 200 is strongly influenced by the size of the delay search range. Thus, it is desired not to search in a range any longer than necessary. In an exemplary embodiment, the delay search range is chosen to be 50% greater than the maximum expected propagation delay. The chosen length of this search range provides a minimum bound for the length of the captured wet and mono dry sequences. The upper bound for the sequence length is defined by the amount of memory storage available in the sound enhancement device 200 as well as how long the listener 150 is willing to wait for the delay-searching method 400 to capture the sequences and offer a delay value 282 to the stereo programmable delay line 230.

For example, for an event inside a concert hall where the farthest audience seating areas are roughly 300 feet from the speakers 140 near the stage (which would correspond roughly to a 270-millisecond propagation delay), it may be desired to limit the delay search to the range between 0 and 400 milliseconds so that the search range exceeds the maximum expected propagation delay by about 50%. Thus, the captured wet and mono dry sequences are desirably at least 400 milliseconds in length. However, they can be longer than that, with increased length theoretically improving the chances of finding an accurate delay time. For a search range of 400 milliseconds, an exemplary value of 3 seconds may be used for the lengths of the captured wet and mono dry sequences.

It is to be understood that the sound enhancement device 200 and the method 400 may be employed in events having different maximum propagation delays. Thus, the delay search range and sequence length could be changed from event to event based on expected seating areas. The distance from the primary sound system 140 to the farthest seating area could be transmitted to the sound enhancement device 200, such as in the initiation Step 410, as auxiliary data encoded within the dry signal 175 (272) captured in the Step 420.

In an exemplary embodiment, processing continues to a Step 425 in which the wet sequence and the mono sequence are low-pass filtered and down-sampled for computational efficiency. Down-sampling reduces the amount of computations that need to be performed. Generally, this is a result of a trade-off among computational power of the sound enhancement device 200, time resolution in the final calculated delay time, and the frequency bandwidth over which the delay is determined. If the original dry and wet signals 212 and 262 are sampled at a standard 48 kHz rate, down-sampling by a factor of 8 in the Step 425 to a sampling rate of 6 kHz will allow an analysis bandwidth that goes up to the Nyquist frequency of 3 kHz, while reducing computation complexity by a factor between 24 and 64. It is to be understood that down-sampling by other factors, such as 2, 4, 12, etc., in the Step 425 is contemplated. It is also to be understood that if the sound enhancement device 200 has sufficient computational power, down-sampling in the Step 425 may be skipped.

Continuing with the method 400, processing continues to a Step 430, in which the power spectrum of the mono dry sequence is calculated and examined. If the method 400 determines that the mono dry sequence does not contain significant power over a chosen bandwidth (the upper end of the bandwidth desirably being defined by half of the down-sampling frequency chosen in the Step 425), the method 400 determines that the primary sound system 140 is not emitting much sound. Such may be the case if the audible acoustic signal 145 has been muted, or the sources 110 and 120 are in between active sound generation, e.g., between songs (at a music concert), between speakers (at a speaking engagement), between scenes or acts (in a movie, musical, or play). If the method determines that the primary sound system 140 is not emitting much sound, further calculations may only yield extremely noisy results and likely lead to an inaccurate calculation of the IR and an inaccurate chosen delay time.

Another difficulty in getting an accurate IR estimate results from the spectral content generated by the sources of sound 110 and 120. This spectral content is contained in the dry signal 222 and in the wet signal 272 because both are sourced from the sources of sound 110 and 120. The delay-searching method 400 yields the most accurate IR/TF result if the spectrum of the dry signal 222 is broadband noise. However, at the time the delay-searching method 400 is executed, sound generated by the sources of sound 110 and 120 may be just a single instrument, voice, sound effect, etc., which may have a limited spectrum and may also contain mainly harmonically-related spectral components. Having mostly harmonically-related components in the spectrum implies some level of periodicity in the time waveform of the dry signal 222, and such periodicity can translate directly to periodicity errors in the estimated IR. Instead of a clearly identifiable, sharp, single peak corresponding to the difference in propagation delay between the dry signal 222 and the wet signal 272, false peaks could be scattered throughout the IR, some of which could end up being larger in amplitude than the peak corresponding to the true propagation delay time, especially if outside noise and other sources of error are also included in the wet signal 272.

Thus, when the Step 430 determines that the mono dry sequence does not contain a sufficient spectral power level or density over a chosen bandwidth, the method 400 loops back to the Step 420 for capturing another pair of finite time sequences of the mono dry and wet signals. Processing continues in the Step 420, as described above. The method 400 may loop through the Steps 420, 425, and 430 until a dry sequence with a sufficient power spectrum is found.

If a dry sequence with a sufficient power spectrum is found, the method 400 calculates an estimate of the IR/TF between the wet sequence and the mono dry sequence using a cross-correlation or deconvolution algorithm, such as a least mean squares (LMS) adaptive filter, dual-channel FFT analysis, or a similar algorithm, Step 435. In an exemplary embodiment, the length of the estimated IR/TF is chosen to be the same as the length of the chosen delay search range, such as the 400 msec example mentioned above. The deconvolution algorithm used in the Step 435 may inherently include an error factor related to the signal-to-noise ratio (for example, a prediction error if an LMS filter is used or a coherence spectrum if a dual-channel FFT process is used). In a Step 440, if the method determines that the error factor indicates a poor signal-to-noise ratio (SNR), processing loops back to the Step 420 for capturing another pair of finite time sequences of the mono dry and wet signals. Processing continues in the Step 420, as described above. The method 400 may loop through the Steps 420, 425, 430, 435, and 440 until a dry sequence with a satisfactory error factor indicating a reasonable SNR is obtained.

If a reasonable SNR is obtained, processing continues to a Step 445 in which a high-pass filter is applied to the IR/TF estimated in the Step 435. When creating a speaker system designed to be used in a large acoustic space 190, such as near a stage in a concert hall or near a screen in a video presentation in a large theater or stadium, it is desirable to have speakers with very high and constant directivity at all frequencies so that emitted sound can be aimed at listener areas to minimize reflections or echoes bouncing off walls, ceilings, support structure, and other objects. Reflections may arrive at the listener areas, thus degrading the sound perceived by the listeners in those areas. However, it is understood that speaker systems used as primary sound systems lose directivity control due to limitations inherent in the physics of acoustics as the frequency of emitted sound gets lower. Therefore, it is expected that the microphone 260 in the sound enhancement device 200 may pick up more reverberations at lower frequencies than at higher frequencies.

Since human hearing is most sensitive not at lower frequencies but near 3 kHz, the delay-searching method 400 desirably concentrates on frequencies around 3 kHz. To do this, the high-pass filter is applied to the estimated IR in the Step 445. The high-pass filter is desirably a zero-phase filter so as not to disrupt the time information inherent in the IR. Shifting the time of the IR's peak would introduce error into the delay calculation and lead to undesired delay applied to the dry signal 222 in the programmable delay line 230. In an exemplary embodiment, the high-pass filter has a cutoff frequency of around 500 Hz.

Figure 5A:
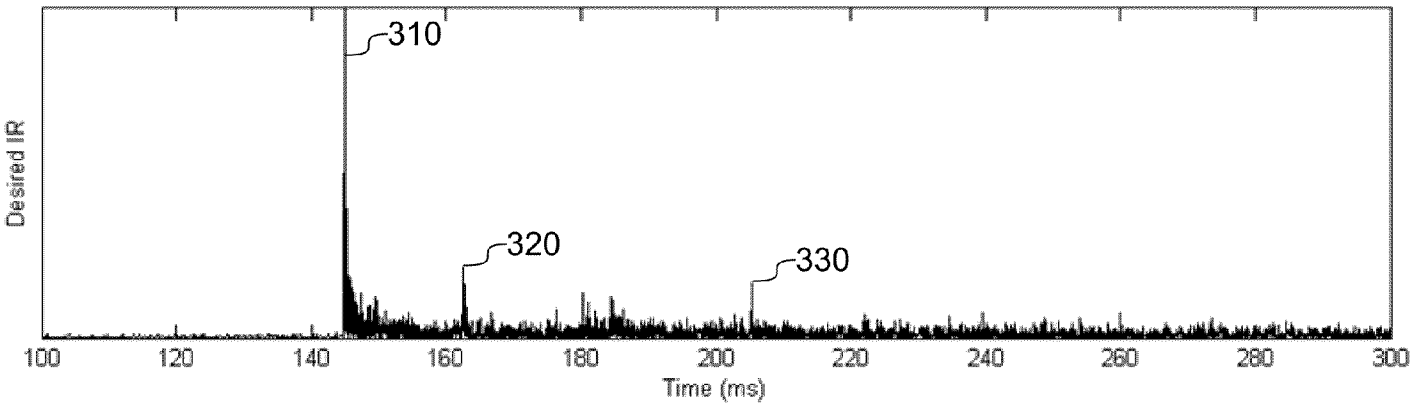
FIG. 5A illustrates an exemplary linear plot of the desired impulse response of FIG. 3, in accordance with an exemplary embodiment of the present invention.

Referring now to FIG. 5A, there is illustrated an exemplary linear plot of the magnitude of the desired IR 300 over time, which IR would be desirably estimated in the Step 435, in accordance with an exemplary embodiment of the present invention. The plot in FIG. 5A may be considered to be an ideal plot of the impulse response, but it is expected that such a clear impulse response may not result from the Step 435. As shown in the figure, the peak magnitude 310 is clearly identifiable at about 145 msec.

Figure 5B:
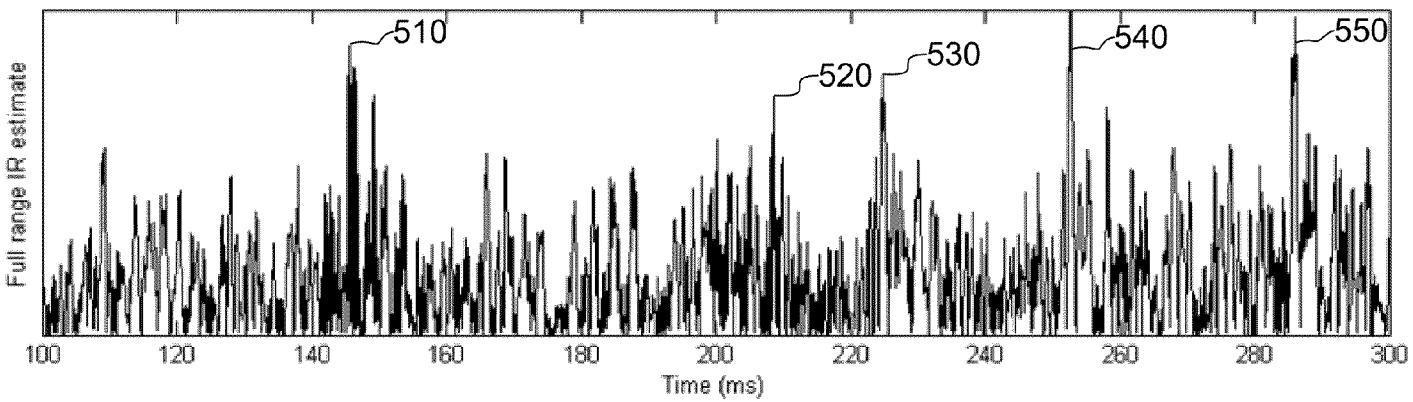
FIG. 5B illustrates an exemplary plot of a measured impulse response, in accordance with an exemplary embodiment of the present invention.

Illustrated in FIG. 5B is an exemplary linear plot of the magnitude of an IR over time, which IR may be expected to be estimated in the Step 435, in accordance with an exemplary embodiment of the present invention. As seen in this figure, there are strong peaks at 145 msec, 207 msec, 224 msec, 253 msec, and 286 msec, respectively labeled as 510, 520, 530, 540, and 550 in the figure. A highest peak magnitude is not clearly evident from the figure, and, in fact, the peaks 540 and 550, respectively at 253 msec and 286 msec, are higher than the true peak 510 at 145 msec, which would lead to an incorrect calculation of the delay.

Figure 5C:
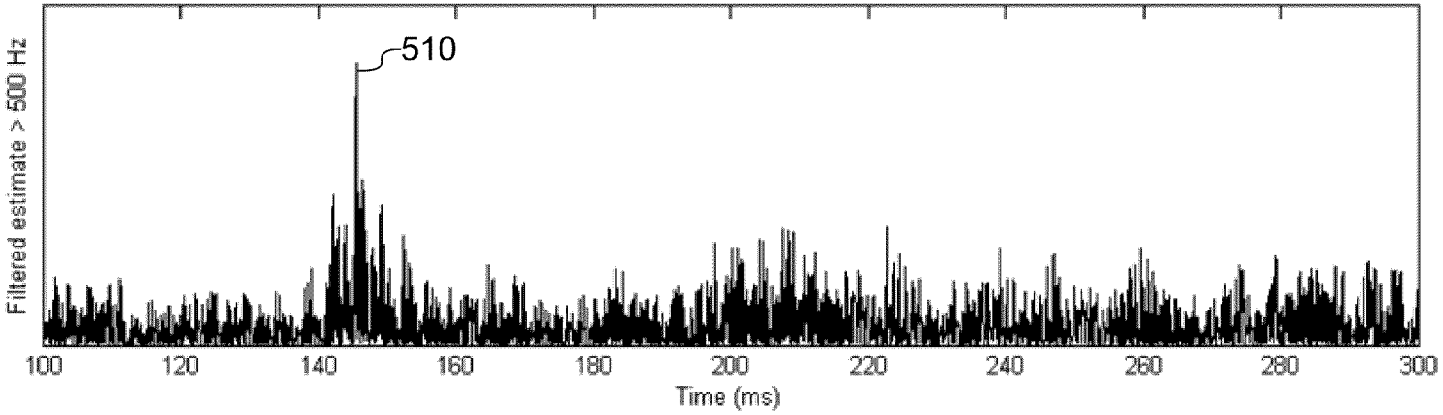
FIG. 5C illustrates an exemplary plot of the measured impulse response of FIG. 5B after being passed through a high-pass filter, in accordance with an exemplary embodiment of the present invention.
Figure 5D:
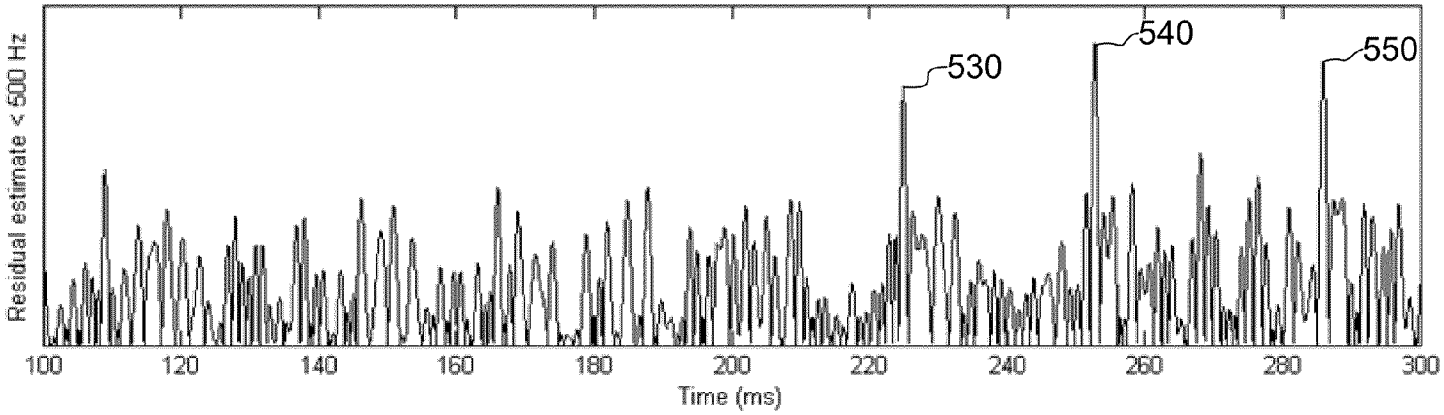
FIG. 5D illustrates an exemplary plot of the measured impulse response of FIG. 5B after being passed through a low-pass filter, in accordance with an exemplary embodiment of the present invention.

In FIG. 5C, there is illustrated a plot of the estimated IR of FIG. 5B after passing it through the high-pass filter in the Step 445, in accordance with an exemplary embodiment of the present invention. As shown in this figure, the peak 510 at 145 msec is clearly identifiable over the remainder of the plot. The peaks 520, 530, 540, and 550 have been so greatly reduced that they do not appear visible in FIG. 5C. FIG. 5D illustrates the data removed from the estimated IR shown in FIG. 5C, in accordance with an exemplary embodiment of the present invention. In this figure, the peaks 530, 540, and 550 are still visible, thereby showing that the false peaks in the plot of FIG. 5B are mainly attributable to sound frequencies below the range where human hearing is most sensitive.

After applying the high-pass filter in the Step 445, the delay-searching method 400 scans the estimated IR for the time having the largest magnitude, Step 450. This time is the estimated delay. Thus, the method 400 now has its best estimate of the true IR from the primary speaker system 140 to the listener 150 and an estimate of the delay, as identified by the time corresponding to the peak in the high-pass filtered IR estimate. At this point, the delay-searching method 400 could pass the estimated delay as the calculated delay 282 to the stereo programmable delay line 230, which would delay the left and right dry signals 222A and 222B and output the delayed left and right dry signals as 232A and 232B. The delayed left and right dry signals 232A and 232B would then be converted to analog via the D/A converter in the amplifier 240, amplified by the stereo headphone amplifier 240, and provided to the headphones 180 for emission as the supplemental acoustic signal 185.

It is possible, however, in the Step 450, that a false estimated delay value is determined or that a delay value cannot be determined. To the first point, if the estimated delay value is incorrect, combining the supplemental acoustic signal 185 emitted by the headphones 180 with the audible acoustic signal 145 from the primary speakers 140 at the listener's ears 150 could make the perceived sound quality worse rather than better if the estimated delay time used was somehow in error.

To the second point, another impediment to accurate IR estimation is any noise picked up by the microphone 260, which noise is not related to the audible acoustic signal 145 emitted by the primary sound system 140. Such noise may derive from crowd noise (background talking), traffic noise, HVAC system noise, etc. This noise may increase the measurement noise of the microphone 260. The measurement noise is problematic because it may have a noticeable effect at the beginning and end of the IR estimated in the Step 435, thereby possibly masking the sharp transition in the IR corresponding to the point of arrival of the audible acoustic signal 145 at the listener 150's ear. In some cases, the statistically random nature of the noise could make a false peak in the IR greater in magnitude than the peak corresponding to the propagation delay of the audible acoustic signal 145.

Thus, in an exemplary embodiment, because of the possibility of estimating a false delay time or because of the inability to estimate a delay time, processing in the method 400 continues via A to a Step 455 and further steps thereafter to determine whether there is too much noise to make an accurate delay-value decision and to increase the confidence that the correct delay time has been found in the Step 450.

In a Step 455, the method 400 calculates the average magnitude of the whole estimated IR and compares it to the peak magnitude determined in the Step 450 and assumed to correspond to the audible acoustic signal 145 to obtain an overall peak-to-average ratio. If this ratio indicates a good IR estimate, processing in the method 400 continues to the Step 460. Otherwise, it loops back to the Step 420 via B for capturing another pair of finite time sequences of the mono dry and wet signals. Processing continues in the Step 420, as described above. Any delay 282 previously calculated and applied to the stereo programmable delay line 230 is not changed so that any delay applied to the left and right dry signals 222A and 222B is not changed. In an exemplary embodiment, a peak-to-average ratio indicating a good IR estimate is 20 db. Thus, if the peak-to-average ratio is equal to or greater than 20 db, processing in the method 400 continues to the Step 460.

In an exemplary embodiment, rather than the average magnitude being computed in the Step 455, the root mean square (RMS) for the whole IR is calculated if the computation power in the sound enhancement device 200 is sufficient to perform this calculation, which is more complex than an average. The Step 455 compares the peak to the calculated RMS to determine a peak-to-RMS ratio. If this ratio indicates a good IR estimate, processing in the method 400 continues to the Step 460. Otherwise, it loops back to the Step 420 via B, and any delay 282 previously calculated and applied to the stereo programmable delay line 230 is not changed so that any delay applied to the left and right dry signals 222A and 222B is not changed. In an exemplary embodiment, a peak-to-RMS ratio indicating a good IR estimate is 20 db. Thus, if the peak-to-RMS ratio is equal to or greater than 20 db, processing in the method 400 continues to the Step 460.

In an exemplary embodiment, in the Step 455, the average or RMS of just the beginning and ending noise floor is also calculated and compared to the peak magnitude. If the Step 455 determines that this peak-to-average or peak-to-RMS is not high enough to indicate a good IR estimate, the method 400 loops back to the Step 420. It is to be understood that the beginning and ending noise floor may be selected to be the first and last 10 msec in the IR. Alternatively, the beginning and ending noise floor may be selected to be the first and last 2.5% of the IR.

While a propagation delay of a system is most easily visible in a plot of the system's IR magnitude versus time, as shown in FIG. 3 for example, the propagation delay is also inherently contained in the phase response of the system's TF. It is typically much more difficult to extract a meaningful delay time from the system's TF. In the case of the IR's peak-to-average ratio or the peak-to-RMS ratio calculated in the Step 455, if the ratio is not as great as would be preferred and the processing power of the sound enhancement device 100 is sufficient, then in an exemplary embodiment the method 400 continues to a Step 460 to gain extra confidence in the estimated delay time, especially since a delay value calculated from the TF is more easily pinpointed to a specific frequency range. Otherwise, the method 400 skips to the Step 470 described below and outputs the estimated delay value from the Step 450 as the delay 282.

In the Step 460, if the TF is not already known, the TF is calculated from the estimated IR using common Fourier transform techniques, Step 460. However, the TF may be known by the time the method 460 reaches the Step 460 as it may be a natural part of the process performed in the Step 435. The Step 460 estimates the propagation time of the audible acoustic signal 145 by calculating the group delay of the TF for each of a plurality of frequencies over a chosen frequency band. The Step 460 then averages the group delays of the TF over the chosen frequency bandwidth. In an exemplary embodiment of the Step 460, the chosen frequency band includes the frequencies near 3 kHz, where the human ear is most sensitive. In yet another exemplary embodiment of the Step 460, if the sound enhancement device 200 has sufficient computation power, the Step 460 applies an unwrap function to the TF's phase response before calculating the group delays and averaging them over the chosen frequency band. In an alternative exemplary embodiment of the Step 460, calculating the average phase delay from that unwrapped phase response may provide a more accurate answer than the average group delay.

The average group delay or the average phase delay calculated from the TF is then compared to the estimated delay time from the IR's highest peak search determined in the Step 450, Step 465. If the two values do not match within a certain amount, the Step 465 determines that the delay search performed in the Step 460 is invalid and processing loops back to the Step 420 via B for continued processing, as described above. If the Step 465 determines that the delay times match to an acceptable degree thus satisfying a confidence criterion, the delay-searching method 400 outputs the delay corresponding to the IR's highest peak determined in the Step 450 as the delay time 282, Step 470. The method 400 is complete, Step 475. For example, if the Step 465 determines that the delay times match to within 5 msec, the delay-searching method 400 outputs the delay corresponding to the IR's highest peak determined in the Step 450 as the delay time 282 in the Step 470. In an exemplary embodiment, the method 400 and, therefore, the sound enhancement device 200 can typically calculate the delay 282 to within an error of less than 1 millisecond to the true propagation delay.

As shown in FIG. 2, the delay time 282 is input to the stereo programmable delay line 230. The stereo programmable delay line 230 receives the delay time 282 and uses it to delay the left and right dry signals 222A and 222B and output them as delayed left and right dry signals 232A and 232B to the stereo headphone amplifier 240. The stereo headphone amplifier 240 amplifies the signals 232A and 232B, converts them to analog, and outputs them to the headphone 180 via the output 250. The headphones 180 reproduce the analog, amplified signals as the enhanced or supplemental audible acoustic signal 185, which is synchronized to the audible acoustic signal 145.

In an exemplary embodiment, the delay line 230 compares the new delay time 282 to the previous delay time 282 used by the delay line 230 prior to completion of a most recent iteration of the method 400. If the new delay value 282 is significantly different from the previous delay time 282, the stereo programmable delay line 230 may switch immediately to the new delay value 282 because the large error of the old value 282 would have obviously sounded incorrect to the listener 150. On the other hand, if the new delay value 282 is close to the previous one, perhaps within 30 msec, the previous delay time 282 may be ramped at a fairly slow rate, perhaps about 3 ms/sec, to the new delay time 282 so the change in the delay 282 is not audibly obvious to the listener 150.

Depending on the hardware of the sound enhancement device 200, the delay value 282 may need to be adjusted to compensate for any extra latency inherent in the microphone preamplifier and A/D converter 270, in the D/A converter of the stereo headphone amplifier 240, and in the delay-searching method 400 employed by the delay-searching algorithm 200. Thus, in an exemplary embodiment, after receiving the delay time 282, the stereo programmable delay line 230 adjusts the delay time 282 to account for the extra latency inherent in the sound enhancement device 200.

The description of the method 400 above refers to a previous delay time 282. The previous delay time 282 may be the result of the method 400 being previously performed or may be the result of an initial best guess. Upon startup of the sound enhancement device 200 and prior to the method 400 being performed, the delay time 282 has no value. In an exemplary embodiment, the stereo programmable delay line 230 may wait for a first value of the delay time 282 to be calculated by the method 400 before delaying the left and right dry signals 222A and 222B for a first time by the first value of the delay time 282. In another exemplary embodiment, the listener 180 may be prompted by the sound enhancement device 200 to input the distance to the primary sound system 140 or the present location of the listener 150, e.g., seating section, seat number, etc. Using the distance to the primary sound system 140 or an estimate of such distance based on the present location of the listener 150 and the propagation speed of sound through air, the sound enhancement device 200 calculates an initial estimate for the delay time 282 and uses that to initially delay the left and right dry signals 222A and 222B. In yet another exemplary embodiment, the left and right dry signals 222A and 222B may include encoded data providing a suggested initial delay time 282. The stereo programmable delay line 230 may use such delay time 282 to delay the left and right dry signals 222A and 222B until the method 400 computes a value for the delay time 282.

The method 400 may be repeated on a periodic basis to ensure that the delay time 282 is valid. Once a new delay time 282 has been applied to the delay line 282, the sound enhancement device 200 may continue using the delay time 282 until manually prompted by the listener 150 to recalculate the delay time 282, or it can immediately (or after a delay) re-execute the delay-searching method 400. Automatic re-execution of the delay-searching method 400 is considered useful when the listener 150 is moving, but due to the computation intensity of the method 400, it will consume extra battery power. Another possibility is that the delay-searching method 400 restarts itself at regular intervals (e.g., 2 minutes) to automatically compensate for changes in propagation delay due to a change in the speed of sound, which is dependent on the temperature of the air and thus can vary over time.

As described above, the listener 150 is able to use the sound enhancing device 200 while moving about the acoustic space 190 through which the acoustic signal 145 is transmitted. In an exemplary embodiment, access to the sound data in the wireless signal 175 is restricted through encryption of the wireless signal 175. The system 100 may only provide the sound enhancement device 200 with access if the listener 150 has paid a fee for access. Thus, the listener 150 may be prompted by the sound enhancement device 200 to input a password to access the wireless signal 175 and begin sound enhancement. In an alternative embodiment, the system 100 may unlock the device 200 remotely.

As mentioned above, the computation power of the sound enhancement device 200, as well as other resources inherent to the hardware of the sound enhancement device 200, such as the amount of memory available, affects the particular implementation of the sound enhancement device 200 and, specifically, the method 400. Also mentioned above, the computational power of the sound enhancement device 200 may determine the length of the wet and dry mono sequences captured in the Step 420, whether down-sampling or low-pass filtering is performed in the Step 425, the down-sampling factor used in the Step 425, whether the SNR determination is performed in the Step 440, whether the high-pass filtering is performed in the Step 445, whether averaging or RMS is employed in the Step 455, whether the group or phase delay is calculated in the Steps 460 and 465, and how often the method 400 is executed. Such functionality may be implemented or omitted depending on the computational capacity of the particular sound enhancement device 200 used.

The computational power of the sound enhancement device 200 may also allow the performance of additional steps 446 and 456 of the method 400, illustrated in FIGS. 4A and 4B with dashed boxes and lines. Further, the method 400 may perform additional processing in some of the steps of the method 400, as described below.

For example, if the wet and dry sequences are downsampled in the Step 425, the time spacing between the quantized samples of the estimated IR determined in the Step 435 becomes coarser than the spacing between the samples of the dry signal 222 fed through the stereo programmable delay line 230. Thus, it is possible that the ideal delay time will fall on a time value between samples in the estimated IR. To obtain a more accurate delay time, after performing the Step 440 but before performing the Step 450, the method 400 may proceed to a Step 446, in which the IR is interpolated (upsampled) to find the amplitude values between the samples of the estimated IR. FIG. 4A illustrates the exemplary alternative Step 446 being performed between the Steps 445 and 450 for computational efficiency, although it is to be understood that the Step 446 may be performed between the Steps 440 and 445.

Another example of additional processing relates to use of energy-time curve (ETC) calculated from the estimated IR. When acousticians examine an IR of a large acoustic space (typically to quantify the decay time), it is not unusual to use the Hilbert transform to create an ETC from the IR. The ETC is similar in character to the IR from which it is created, but typically represents the envelope of the IR's waveform. Scanning the ETC instead of the IR for the appropriate delay time may or may not offer a small advantage in accuracy depending on the nature of the acoustic environment of the acoustic signal 145. Thus, in an exemplary embodiment, the Step 450 further comprises applying a Hilbert Transform to the estimated IR from the Step 435 to generate the ETC and scanning the ETC instead of the estimated IR to identify the time sample having the largest magnitude to provide an estimate of the delay time.

Yet another example of additional processing relates to confidence criteria. In an exemplary embodiment of the method 400, there are several steps in which confidence criteria are tested and the method 400 restarted if certain criteria are not met. For example, it is possible that the Steps 420 through 455 could be repeated many times and the peak-to-average or peak-to-RMS ratio in the Step 455 never indicates a good IR estimate because of outside noise. If such were to happen, the method 400 would be stuck in a loop.

Accordingly, in an exemplary embodiment, the delay-searching algorithm 400 maintains a counter to count the number of times the method 400 loops through the Steps 420-455 without passing to the Step 460. Each time the Step 455 determines that the estimated IR's peak-to-average or peak-to-RMS ratio is not high enough to indicate a good IR estimate, the counter increments, Step 456. If, in the Step 456, the method 400 determines that the counter equals or exceeds a predetermined number of loops, the method 400 does not return to the Step 420 after the Step 455 but proceeds to the Step 460 to see if a valid delay time can still be determined even though confidence that such delay time is accurate will be diminished. Otherwise, the method 400 loops back to the Step 420 from the Step 456.

Building on this exemplary embodiment, in a further exemplary embodiment, the delay time estimated in the Step 450 is temporarily stored in either the Step 455 or the Step 456. When the loop of the Steps 420 through 456 is repeated, each estimated delay time is compared in the Step 456 to the estimated delay times from prior loops to determine how consistent the estimated delay times are. If the Step 456 determines that estimated delay times are consistent after reaching or exceeding its predetermined number of loops, i.e., that the estimated delay times satisfy the confidence criteria, processing in the method 400 continues from the Step 456 to the Step 460, and the average of the estimated delay times stored during the loops among the Steps 420 through 456 is used as the estimated delay time in the remaining steps in the method 400. For example, if the estimated delay times stored during looping among the Steps 420 through 456 are within 5 msec of one another, with one outlier tossed out, after five loops through the Steps 420 through 455, the method 400 will continue from the Step 456 to the Step 460 and use the average delay time as the estimated delay time for the remaining steps of the method 400.

A further example of additional processing relates to adjusting the captured mono dry sequence of interest. The maximum delay time which might be needed will define the time range over which the IR/TF should estimated. This time range varies, depending on the event. At large outdoor events, the listener 150 could be located at a position such that the acoustic propagation delay of the audible acoustic signal 145 from the primary sound system 140 is 1 second or even longer. Such long delays may be the exception rather than the rule. Thus, the method 400 is not normally initialized to estimate an IR in the Step 435 that is longer than such long delays, especially because the number of computations of the method 400 is related to the length of the IR estimated in the Step 435. For example, doubling the length of the estimated IR in the Step 435 can, in some cases, increase the number of computations required by a factor of 4.

Thus, in an exemplary embodiment of the method 400, the first pass through the method 400 could start out with the assumption that the delay time is likely to be less than some value, e.g., 400 msec, and confine the delay search range and thus the estimated IR to that length for computational efficiency. If the confidence criterion of the current IR estimate is not met in the Step 465, then the method 400 loops back to the Step 420, in which the wet sequence is kept the same but the mono dry sequence of interest is shifted by 300 msec, effectively isolating the search to the 300 msec to 700 msec range of the mono dry sequence. If the confidence criterion of that IR estimate is still not met in the Step 465, then the mono dry sequence of interest is shifted by another 300 msec to isolate the search to between 600 msec and 1 sec, and so on up to some predetermined limit, e.g., 5 sec. Note that the amount of time shift added to the mono dry sequence in each loop should be less than the total IR estimate length in order to maintain some overlap in the delay search windows to avoid problems in a caser where the true propagation delay time falls on a boundary time, i.e., near the very end of one sequence or the very beginning of the following sequence. Overlap between sequences may be 25% of sequence length, in an exemplary embodiment. With this technique it may take a while for the sound enhancement device 200, if it and the listener 150 are located a far distance from the primary sound system 140, to get an accurate time delay value quickly. However, if the listener 150 and the sound enhancement device 200 are within 400 msec of the primary sound system 140, a quick answer with a low amount of computation may be found. If the listener 150 is far away from the stage, he or she will likely be more tolerant of long delay-searching times.

A still further example of additional processing relates to adjusting the length of the estimated IR in the Step 435 and the down-sampling factor used in the Step 425 in conjunction with the features of storing and comparing/refining the estimated delay times in the exemplary Step 456. As described above, in one embodiment of the method 400, the wet and mono dry sequences captured in the Step 420 are down-sampled by a factor of 8 in the Step 425 to reduce computation requirements on the sound enhancement device 200, and the IR is determined with a length of 400 msec. In an alternative exemplary embodiment, to reduce computation requirements for the acoustic signal 145 having an expected long delay time, the wet and mono dry sequences are down-sampled by a higher factor (higher than 8) in the Step 425, and the IR is determined over a longer length to include the expected long delay time. The drawback of down-sampling by a higher factor, however, is that the highest frequencies included in the delay-searching method 400 are reduced, thereby increasing the likelihood of error in the estimated delay time, but the amount of error in the estimated delay time caused by lower-frequency reverberations, and other factors, has a high chance of being on the order of 200 milliseconds or less.

Once an initial estimate is found with the long time window, processing continues through the Step 456 in which the counter is incremented and the initial estimate is stored. Processing continues back to the Step 420, and the loop of the Steps 420 through 456 can be repeated a second time with a less-restrictive down-sample rate in the Step 425, a shorter estimated IR time length in the Step 435, and the dry signal delayed appropriately in the Step 420 so that the initial estimated delay time in the Step 450 falls within the middle of the smaller time window of the estimated IR. The loop of the Steps 420 through 456 may continue until the counter reaches or exceeds the predetermined number of loops or until the Step 456 determines that the estimated delay satisfies the confidence criterion. This can yield an accurate answer for the estimated delay time with a good trade-off in computation power required, memory resources required, and average length of time to find the estimated delay time.

As mentioned previously, in order for the IR/TF estimate, and hence the calculated delay time 282, to be as accurate as possible, the dry signal 222 used as the reference input signal to the delay-searching method 400 should be substantially the same as the primary acoustic signal used to drive the primary sound system 140. Otherwise, information contained in the audible acoustic signal 145 emitted by the primary sound system 140 (and therefore picked up in the measured wet signal 272) that is not included in the dry signal 222, or vice versa, will appear to the delay-searching method 400 as added noise, hindering the ability of the method 400 to find an accurate propagation delay time 282.

In the examples discussed so far, it has been assumed that the dry signal 222 and the primary acoustic signal driving the primary sound system 140 are stereo, in other words two different signals, typically designated left and right. Having stereo speaker clusters for the primary sound system 140 is common practice, for example, at a musical concert event. However, the delay-searching method 400 can use only one dry signal at a time, input in the Step 420, to compare to the wet signal 272. In the example given, the left and right signals 242A and 242B are summed together in the Step 415 to create this single mono dry input signal to use in the Step 420 and subsequent steps in delay-searching method 400.

However, the listener 150 could be seated fairly close to a left speaker of the primary sound system 140 and much farther away from a right speaker of the primary sound system 140. Thus, the wet signal 272 picked up by the microphone 260 inside the sound enhancement device 200 and digitized by the preamplifier and A/D converter 270 will be dominated by the information in the left dry signal, which could be different than the information in the right dry signal. Accordingly, in an exemplary embodiment, if there is sufficient computation power in the sound enhancement device 200, higher confidence in the accuracy of the calculated delay time 282 could be achieved by running the delay-searching method 400 several times: once using just the left dry signal as the reference signal, once using just the right dry signal, and once using a mono sum of both the left and right signals. The summing step 415 would be used to compute the mono dry signal and would be bypassed for delay-searching with respect to the left and right dry signals individually. Whichever of those searches yields the best peak-to-average (or peak-to-RMS) ratio in the estimated IR (or the least mean or mean-square deviation in the average group delay calculations on the TF's phase response) is the one whose delay answer is likely most accurate and should be applied to the stereo programmable delay line 230.

In some applications of the sound enhancement device 200, there may be a desire for the listener 150 to hear a signal or signals through the headphones 180 that are different than the acoustic signals 145 emitted by the primary sound system 140. For example, at a music concert, the performing artists may want to play special sounds or messages exclusively to their fans using the sound enhancement device 200. Adding this extra audio information, which is not present in the acoustic signal 145, into the dry signal before transmitting the wireless signal 175 to the sound enhancement device 200 forces the dry signal 222 to appear to include unwanted noise to the delay-searching method 400. This extra audio information instead could be encoded into the wireless signal 175 in such a way that it can be decoded inside the sound enhancement device 200 as a separate signal or signals.

In an exemplary embodiment, the sound enhancement device further comprises a supplemental audio decoder 225, which decodes the extra audio information embedded within the dry signal 212. The supplemental audio decoder 225 outputs the decoded extra audio information to the stereo programmable delay line 230, which mixes it with the dry signal 222 before delaying and outputting the combined signal as signal 232. The wireless stereo receiver/decoder 220 removes the extra audio information from the dry signal 222 provided to the delay-searching algorithm 280.

In some applications it may be desirable to use the dry signal provided to the primary sound system 140 and to the computer 160 inside the sound enhancement device 200 solely for the purpose of the delay-searching process 400, with alternate signals decoded in the wireless stereo receiver/decoder 220 and sent solely to the stereo programmable delay line 230 for output to headphones 180. In this application, the dry signal 222 is provided to the delay-searching algorithm solely for the purpose of calculating the delay 282. The dry signal 222 is not provided to the stereo programmable delay line 230. Only, the alternate signals are.

For example, at a music concert these alternate signals could be an enhanced stereo mix, with the vocals more pronounced and/or some instruments panned harder left or right than in the dry signal, plus perhaps with some ambient sound also mixed in. As another music concert example, these alternate signals could be stem mixes transmitted along with the dry signal, with example stems being drums, bass guitar, lead guitar, piano, and vocals. The listener 150 could then have the option of adjusting the level of each stem inside the sound enhancement device 200 to create his or her own unique final sound mix heard in the headphones 180. One listener might prefer to hear the vocals louder than the other stems, while another listener might prefer to hear the drums or one of the other stems louder. The final stereo sound mix created by the listener 150 still should be delayed by the appropriate amount of time based on the propagation delay from the primary sound system 140 to the position of the listener 150 and the sound enhancement device 200, hence why those alternate signals should pass through the stereo programmable delay line 230, and the unmodified dry signal 222 must still be used in the delay-searching algorithm 280 even though it will not be played through the headphones 180. Note that the relative time offset between the dry signal and the alternate signals must be maintained throughout the audio mixing, encoding, wireless transmission, and decoding process so that the delay 282 calculated by the delay-searching algorithm 280 using the dry signal 222 accurately applies to the alternate signals.

In other applications, it may be desirable to include video within the wireless signal 175. Such video may be of the performance relating to the sources of sound 110 and 120. In such embodiment, the sound enhancement device 200 further comprises a video decoder, a video delay, and a screen for playing video. The video decoder removes the video from the dry signal 222 so that the video does not appear as noise within the dry signal 222. The video decoder provides the video to the video delay, which also receives the delay 282 as an input. The video delay delays the video by the delay 282 and provides it to the video screen for display to the listener 150. In this case, the listener 150 is also a viewer 150. In an exemplary variation on this embodiment, the sound enhancement device 200 may allow the listener/viewer 150 to request a live version of the performance, including both sound and video, for purchase and download to the sound enhancement device. The listener/viewer 150 may select a link on the interface of the sound enhancement device 200, which causes the sound enhancement device 200 to transmit the request for purchase to the computer 160. The computer 160 may then transmit the requested audio and/or video to the sound enhancement device 200 or arrange for such audio and/or video to be transmitted to the listener/viewer 150 by other electronic means, e.g., download via a website. In another variation on this exemplary embodiment, it may be desirable to include text within the wireless signal 175. Such text may include information relating to the sound or video being transmitted, such as a live set list naming the music being played, or other text information about the music being played (sourced in the sources of sound 110 and 120), such as a text narration. Alternatively, text may be broadcast via a wireless signal separate from the wireless signal 175. In each of these embodiments, the sound enhancement device 200 includes a decoder configured to decode the text and remove it from the dry signal 222.

Another desire may be to mix, encode, and wirelessly transmit two different signals representing an enhanced binaural 3D version of the audio signal 145 being played out of the primary sound system 140. There are significant limitations to the effectiveness of 3D or surround sound using large speakers that are located at various positions in a large acoustic venue, mainly due to the fact that each listener is at a different position in the venue and so perceives the 3D/surround effect very differently. If the 3D or surround effect is instead created using head-related transfer functions and played through personal headphones, each listener perceives the 3D/surround effect optimally. However, not every listener at an event may have a sound enhancement device 200 and headphones 180, so there will still be a primary speaker system 140 emitting sound which will be perceived by the listener 150, and the binaural 3D-enhanced signals will still need to be delayed appropriately to account for the propagation delay so that the primary sound 145 and the supplemental sound arrive at the listener's ears in substantial time synchronization. In this case both the unmodified left and right dry signals sent to the primary speaker system as well as the binaural 3D-enhanced left and right signals can be encoded and transmitted wirelessly together in the wireless signal 175, with the decoder in the sound enhancement device 200 decoding the unmodified dry signals 222 and sending them exclusively to the delay-searching algorithm 280 and decoding the binaural 3D-enhanced signals and sending them exclusively to the stereo programmable delay line 230 (and hence to the headphones).

If, instead of a music concert, the event is a movie in a movie theater, the dry signal sent to the center speaker in the movie theater (as an example) could be used as the reference input 222 to the delay-searching algorithm 280 while binaural 3D-enhanced signals representing the movie's surround sound tracks are sent to the stereo programmable delay line 230, providing optimized surround sound for any audience member in the movie theater using a sound enhancement device 200 (no matter where they are seated), which optimized surround sound is also personally time-aligned to the same sound being heard by others in the movie theater who are not using a personal sound enhancement device 200 and whose perception of the surround effect is subject to their seating position relative to the location of the surround speakers.

It is to be understood that the steps of the delay-searching method 400 illustrated in FIGS. 4A-4B and described above may be performed in a general purpose microprocessor of the sound enhancement device 200. For the example mentioned previously where the personal sound enhancement device 200 is a smartphone or a device including a microprocessor capable of executing software instructions, the steps of the delay-searching method 400 are programmed as software instructions, i.e., they are part of a software application (a.k.a. "app"), that, when executed by the microprocessor of the smartphone, perform the steps of the method 400 described above. It is also to be understood that the other additional, alternative, and supplemental functionality described herein may be performed in the general purpose microprocessor of the sound enhancement device 200. Such additional, alternative, or supplemental functionality are programmed as software instructions, i.e., they are part of a software application (a.k.a. "app"), that, when executed by the microprocessor of the sound enhancement device 200, perform such functionality.

Such an application could not only contain features pertaining to the supplemental acoustic signal 185 played out the headphones 180, but it could contain other features as well. For example, there may be events where it would be beneficial to have a supplemental video signal, as described above. The video signal could be transmitted wirelessly, perhaps encoded in the same wireless transmission signal 175 as the dry signal. The same delay time found and applied to the dry audio signal 222 could be applied to the supplemental video signal before that video signal is sent to the smartphone's display, thus ensuring the listener 150 hears and sees the supplemental audio and video signals substantially in time synchronization. In the example of a music concert, the smartphone's display could show a video signal of the performing artists singing and playing their instruments. Instead or in addition, the title and other information about the song currently being played (or the concert's full song set list), possibly including each word of the song's lyrics appearing in time synchronization as it's heard by the listener 150, could be shown on the smartphone's display. The software application could also show an offer for the listener 150 to purchase a recording of the song or the whole concert currently being heard, or other merchandise related to the artist.

As noted above, the general purpose microprocessor included within the sound enhancement device 200 is programmed with software instructions that, when executed by the microprocessor, cause the microprocessor to perform the functionality of the delay-searching method 400. For example, and without limitation, the delay-searching method 400 illustrated in FIGS. 4A and 4B is programmed in software that, when executed by the microprocessor, performs the functionality of the Steps 410 through 475 described above and, optionally, the Steps 446 and/or 456, and the additional or alternate processing for the steps of the method 400 described above, such as analyzing the confidence criteria described above and the additional functionality described herein. It is to be understood that in alternative exemplary embodiments, not all of the steps of the method 400 are performed. For example, in an exemplary embodiment, any or all of the Steps 425, 430, 440, 445, 450, 455, 460, and 465 may be skipped.

It is to be understood that the software instructions executed by the microprocessor of the sound enhancement device 200 are tangibly embodied in a tangible computer-readable medium within the sound enhancement device 200. As used herein, a "computer-readable medium" may include a magnetic medium, such as a computer hard drive within the personal sound enhancement device 200, a magneto-optical medium, such as a magneto-optical drive, solid-state memory, such as flash memory, etc. The computer-readable medium may also include memory devices that are removable from the sound enhancement device 200, as such removable memory devices are known in the art. The software instructions are loaded from the above-mentioned tangible computer-readable medium by the microprocessor within the sound enhancement device 200 and executed by the microprocessor to perform the functionality of the delay-searching method 400 and additions and variations thereto described herein.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention.

What is claimed is:

1. A method of enhancing an acoustic signal, comprising steps of:

sensing an acoustic signal using a microphone in an electronic device, the acoustic signal emitted in response to a primary sound signal and transmitted through a space;

converting the sensed acoustic signal to a digitized acoustic signal;

receiving, using an antenna in the electronic device, a wireless signal encoded with the primary sound signals;

decoding the primary sound signal encoded in the wireless signal as a digital primary sound signal;

estimating an impulse response for the space based on the digitized acoustic signal and the digital primary sound signal;

calculating a delay between the digitized acoustic signal and the digital primary sound signal by scanning the estimated impulse response to identify a peak magnitude of the estimated impulse response;

calculating an average magnitude of the estimated impulse response;

comparing the average magnitude of the estimated impulse response to the peak magnitude of the estimated impulse response to determine a peak-to-average ratio;

delaying the digital primary sound signal using the calculated delay if the peak-to-average ratio exceeds a predetermined value; and reproducing the delayed digital primary sound signal to enhance the acoustic signal heard by a user of the electronic device.

2. The method of claim 1, further comprising a step of high-pass filtering the estimated impulse response.

3. The method of claim 2, wherein;

the step of calculating the delay comprises calculating the delay between the digitized acoustic signal and the digital primary sound signal by scanning the high-pass filtered, estimated impulse response to identify a peak magnitude of the high-pass filtered, estimated impulse response, the step of calculating an average magnitude of the estimated impulse response comprises calculating an average magnitude of the high-pass filtered, estimated impulse response, and the step of comparing comprises comparing the average magnitude of the high-pass filtered, estimated impulse response to the peak magnitude of the high-pass filtered, estimated impulse response to determine the peak-to-average ratio.

4. The method of claim 1, further comprising a step of low-pass filtering the digitized acoustic signal and the digital primary sound signal, wherein the step of estimating the impulse response comprises estimating the impulse response for the space based on the low-pass filtered, digitized acoustic signal and the low-pass filtered, digital primary sound signal.

5. The method of claim 4, further comprising steps of:

down-sampling the low-pass filtered, digitized acoustic signal; and down-sampling the low-pass filtered, digital primary sound signal, wherein the step of estimating the impulse response comprises estimating the impulse response for the space based on the down-sampled, low-pass filtered, digitized acoustic signal and the down-sampled, low-pass filtered, digital primary sound signal.

6. The method of claim 1, further comprising a step of looping through the steps of sensing, converting, receiving, decoding, estimating, and calculating the delay to calculate a plurality of delay times, wherein the step of delaying the digital primary sound signal comprises delaying the digital primary sound signal using an average of the plurality of delay times if the plurality of delay times are consistent.

7. The method of claim 6, further comprising a step of:

capturing a sequence of the digitized acoustic signal and a sequence of the digital primary sound signal, wherein the step of estimating comprises estimating the impulse response for the space based on the captured sequence of the digitized acoustic signal and the captured sequence of the digital primary sound signal, and wherein the captured sequence of the digital primary sound signal is shifted each time the steps of sensing, converting, receiving, decoding, estimating, and calculating the delay are looped through.

8. The method of claim 1, wherein the step of estimating the impulse response comprises performing deconvolution on the digitized acoustic signal and the digital primary sound signal to estimate the impulse response for the space.

9. The method of claim 1, wherein the step of estimating the impulse response comprises performing a cross-correlation algorithm on the digitized acoustic signal and the digital primary sound signal to estimate the impulse response for the space.

10. A method of enhancing an acoustic signal, comprising steps of:

sensing an acoustic signal using a microphone in an electronic device, the acoustic signal emitted in response to a primary sound signal and transmitted through a space;

converting the sensed acoustic signal to a digitized acoustic signal;

receiving, using an antenna in the electronic device, a wireless signal encoded with the primary sound signal;

decoding the primary sound signal encoded in the wireless signal as a digital primary sound signal;

estimating an impulse response for the space based on the digitized acoustic signal and the digital primary sound signal;

calculating a delay between the digitized acoustic signal and the digital primary sound signal by scanning the estimated impulse response to identify a peak magnitude of the estimated impulse response;

calculating a root mean square (RMS) of a magnitude of the estimated impulse response;

comparing the RMS of the magnitude of the estimated impulse response to the peak magnitude of the estimated impulse response to determine a peak-to-RMS ratio;

delaying the digital primary sound signal using the calculated delay if the peak-to-RMS ratio exceeds a predetermined value; and reproducing the delayed digital primary sound signal to enhance the acoustic signal heard by a user of the electronic device.

11. The method of claim 10, further comprising a step of looping through the steps of sensing, converting, receiving, estimating, decoding, and calculating the delay to calculate a plurality of delay times, wherein the step of delaying the digital primary sound signal comprises delaying the digital primary sound signal using an average of the plurality of delay times if the plurality of delay times are consistent.

12. The method of claim 11, further comprising a step of:

capturing a sequence of the digitized acoustic signal and a sequence of the digital primary sound signal, wherein the step of estimating comprises estimating the impulse response for the space based on the captured sequence of the digitized acoustic signal and the captured sequence of the digital primary sound signal, and wherein the captured sequence of the digital primary sound signal is shifted each time the steps of sensing, converting, receiving, decoding, estimating, and calculating the delay are looped through.

13. The method of claim 10, wherein the step of estimating the impulse response comprises performing deconvolution on the digitized acoustic signal and the digital primary sound signal to estimate the impulse response for the space.

14. The method of claim 10, wherein the step of estimating the impulse response comprises performing a cross-correlation algorithm on the digitized acoustic signal and the digital primary sound signal to estimate the impulse response for the space.

15. A method of enhancing an acoustic signal comprising steps of:

sensing an acoustic signal using a microphone in an electronic device, the acoustic signal emitted in response to a primary sound signal and transmitted through a space;

converting the sensed acoustic signal to a digitized acoustic signal;

receiving, using an antenna in the electronic device, a wireless signal encoded with the primary sound signal;

decoding the primary sound signal encoded in the wireless signal as a digital primary sound signal;

calculating a power spectrum of the digital primary sound signal;

determining whether the power spectrum of the digital primary sound signal indicates whether the digital primary sound signal has sufficient power;

estimating an impulse response for the space based on the digitized acoustic signal and the digital primary sound signal if the power spectrum of the digital primary sound signal indicates that the digital primary sound signal has sufficient power;

calculating a delay between the digitized acoustic signal and the digital primary sound signal based on the estimated impulse response;

delaying the digital primary sound signal using the calculated delay; and reproducing the delayed digital primary sound signal to enhance the acoustic signal heard by a user of the electronic device.

16. A method of enhancing an acoustic signal, comprising steps of:

sensing an acoustic signal using a microphone in an electronic device, the acoustic signal emitted in response to a primary sound signal and transmitted through a space;

converting the sensed acoustic signal to a digitized acoustic signal;

receiving, using an antenna in the electronic device, a wireless signal encoded with the primary sound signal;

decoding the primary sound signal encoded in the wireless signal as a digital primary sound signal;

estimating an impulse response for the space based on the digitized acoustic signal and the digital primary sound signal, wherein the step of estimating further comprises calculating an error factor;

calculating a delay between the digitized acoustic signal and the digital primary sound signal based on the estimated impulse response if the error factor indicates a good signal-to-noise ratio for the estimated impulse response;

delaying the digital primary sound signal using the calculated delay; and reproducing the delayed digital primary sound signal to enhance the acoustic signal heard by a user of the electronic device.

17. The method of claim 16, further comprising a step of high-pass filtering the estimated impulse response if the error factor indicates a good signal-to-noise ratio for the estimated impulse response.

18. The method of claim 17, wherein the step of calculating the delay comprises calculating the delay between the digitized acoustic signal and the digital primary sound signal by scanning the high-pass filtered, estimated impulse response to identify a peak magnitude of the high-pass filtered, estimated impulse response if the error factor indicates a good signal-to-noise ratio for the estimated impulse response.

19. A method of enhancing an acoustic signal, comprising steps of:

sensing an acoustic signal using a microphone in an electronic device, the acoustic signal emitted in response to a primary sound signal and transmitted through a space;

converting the sensed acoustic signal to a digitized acoustic signal;

receiving, using an antenna in the electronic device, a wireless signal encoded with the primary sound signal;

decoding the primary sound signal encoded in the wireless signal as a digital primary sound signal;

estimating an impulse response for the space based on the digitized acoustic signal and the digital primary sound signal;

calculating a transfer function from the estimated impulse response;

calculating an average group delay for the transfer function;

calculating a delay between the digitized acoustic signal and the digital primary sound by scanning the estimated impulse response to identify a peak magnitude of the estimated impulse response and comparing a time corresponding to the peak magnitude of the estimated impulse response to the average group delay for the transfer function;

delaying the digital primary sound signal using the calculate delay if a difference between the time corresponding to the peak magnitude of the estimated impulse response and the average group delay is less than a predetermined value; and reproducing the delayed digital primary sound signal to enhance the acoustic signal heard by a user of the electronic device.

20. A device for enhancing sound, the device comprising:

a microphone configured for sensing an acoustic signal, the acoustic signal emitted in response to a primary sound signal and transmitted through a space;

an analog-to-digital converter for converting the sensed acoustic signal to a digitized acoustic signal;

an antenna configured for receiving a wireless signal encoded with the primary sound signal;

a receiver for receiving and decoding the primary sound signal encoded in the wireless signal as a digital primary sound signal;

a processor configured for:

estimating an impulse response for the space based on the digitized acoustic signal and the digital primary sound signal;

calculating a delay between the digitized acoustic signal and the digital primary sound signal by scanning the estimated impulse response to identify a peak magnitude of the estimated impulse response;

calculating an average magnitude of the estimated impulse response; and comparing the average magnitude of the estimated impulse response to the peak magnitude of the estimated impulse response to determine a peak-to-average ratio;

a delay line configured for delaying the digital primary sound signal using the calculated delay if the peak-to-average ratio exceeds a predetermined value; and an output configured for outputting the delayed digital primary sound signal.

21. The device of claim 20, wherein the processor is further configured for high-pass filtering the estimated impulse response.

22. The device of claim 21, wherein:

the calculating of the delay comprises calculating the delay between the digitized acoustic signal and the digital primary sound signal by scanning the high-pass filtered, estimated impulse response to identify a peak magnitude of the high-pass filtered, estimated impulse response, the calculating of the average magnitude of the estimated impulse response comprises calculating an average magnitude of the high-pass filtered, estimated impulse response, and the comparing comprises comparing the average magnitude of the high-pass filtered, estimated impulse response to the peak magnitude of the high-pass filtered, estimated impulse response to determine the peak-to-average ratio.

23. The device of claim 20, wherein the processor is further configured for low-pass filtering the digitized acoustic signal and the digital primary sound signal, wherein the estimating of the impulse response comprises estimating the impulse response for the space based on the low-pass filtered, digitized acoustic signal and the low-pass filtered, digital primary sound signal.

24. The device of claim 23, wherein the processor is further configured for:

down-sampling the low-pass filtered, digitized acoustic signal; and down-sampling the low-pass filtered, digital primary sound signal, wherein the estimating of the impulse response comprises estimating the impulse response for the space based on the down-sampled, low-pass filtered, digitized acoustic signal and the down-sampled, low-pass filtered, digital primary sound signal.

25. The device of claim 20, wherein the processor is further configured for calculating a plurality of delay times, and wherein the delay line is configured for delaying the digital primary sound signal using an average of the plurality of delay times if the plurality of delay times are consistent.

26. The device of claim 25, wherein:

the processor is further configured for capturing a sequence of the digitized acoustic signal and a sequence of the digital primary sound signal, the estimating of the impulse response comprises estimating the impulse response for the space based on the captured sequence of the digitized acoustic signal and the captured sequence of the digital primary sound signal, and the processor is further configured for shifting the captured sequence of the digital primary sound signal in between calculating each of the plurality of delay times.

27. The device of claim 20, wherein the estimating the impulse response comprises performing deconvolution on the digitized acoustic signal and the digital primary sound signal to estimate the impulse response for the space.

28. The device of claim 20, wherein the estimating the impulse response comprises performing a cross-correlation algorithm on the digitized acoustic signal and the digital primary sound signal to estimate the impulse response for the space.

29. A device for enhancing sound, the device comprising:

a microphone configured for sensing an acoustic signal, the acoustic signal emitted in response to a primary sound signal and transmitted through a space;

an analog-to-digital converter for converting, the sensed acoustic signal to a digitized acoustic signal;

an antenna configured for receiving a wireless signal encoded with the primary sound signal;

a receiver for receiving and decoding the primary sound signal encoded in the wireless signal as a digital primary sound signal;

a processor configured for:

estimating an impulse response for the space based on the digitized acoustic signal and the digital primary sound signal;

calculating a delay between the digitized acoustic signal and the digital primary sound signal by scanning the estimated impulse response to identify a peak magnitude of the estimated impulse response;

calculating a root mean square (RMS) of a magnitude of the estimated impulse response; and comparing the RMS of the magnitude of the estimated impulse response to the peak magnitude of the estimated impulse response to determine a peak-to-RMS ratio;

a delay line configured for delaying the digital primary sound signal using the calculated delay if the peak-to-RMS ratio exceeds a predetermined value; and an output configured for outputting the delayed digital primary sound signal.

30. The device of claim 29, wherein the processor is further configured for calculating a plurality of delay times, and wherein the delay line is configured for delaying the digital primary sound signal using an average of the plurality of delay times if the plurality of delay times are consistent.

31. The device of claim 30, wherein:

the processor is further configured for capturing a sequence of the digitized acoustic signal and a sequence of the digital primary sound signal, the estimating of the impulse response comprises estimating the impulse response for the space based on the captured sequence of the digitized acoustic signal and the captured sequence of the digital primary sound signal, and the processor is further configured for shifting the captured sequence of the digital primary sound signal in between calculating each of the plurality of delay times.

32. The device of claim 29, wherein the estimating the impulse response comprises performing deconvolution on the digitized acoustic signal and the digital primary sound signal to estimate the impulse response for the space.

33. The device of claim 29, wherein the estimating the impulse response comprises performing a cross-correlation algorithm on the digitized acoustic signal and the digital primary sound signal to estimate the impulse response for the space.

34. A device for enhancing sound, the device comprising:

a microphone configured for sensing an acoustic signal, the acoustic signal emitted in response to a primary sound signal and transmitted through a space;

an analog-to-digital converter for converting the sensed acoustic signal to a digitized acoustic signal;

an antenna configured for receiving a wireless signal encoded with the primary sound signal;

a receiver for receiving and decoding the primary sound signal encoded in the wireless signal as a digital primary sound signal;

a processor configured for:

calculating a power spectrum of the digital primary sound signal;

determining whether the power spectrum of the digital primary sound signal indicates whether the digital primary sound signal has sufficient power;

estimating an impulse response for the space based on the digitized acoustic signal and the digital primary sound signal if the power spectrum of the digital primary sound signal indicates that the digital primary sound signal has sufficient power; and calculating a delay between the digitized acoustic signal and the digital primary sound signal by scanning the estimated impulse response to identify a peak magnitude of the estimated impulse response;

a delay line configured for delaying the digital primary sound signal using the calculated delay if the power spectrum of the digital primary sound signal indicates that the digital primary sound signal has sufficient power; and an output configured for outputting the delayed primary sound signal.

35. A device for enhancing sound, the device comprising:

a microphone configured for sensing an acoustic signal, the acoustic signal emitted in response to a primary sound signal and transmitted through a space;

an analog-to-digital converter for converting the sensed acoustic signal to a digitized acoustic signal;

an antenna configured for receiving a wireless signal encoded with the primary sound signal;

a receiver for receiving and decoding the primary sound signal encoded in the wireless signal as a digital primary sound signal;

a processor configured for:

estimating an impulse response for the space based on the digitized acoustic signal and the digital primary sound signal, the estimating further comprising calculating an error factor; and calculating the delay between the digitized acoustic signal and the digital primary sound signal based on the estimated impulse response if the error factor indicates a good signal-to-noise ratio for the estimated impulse response;

a delay line configured for delaying the digital primary sound signal using the calculated delay; and an output configured for outputting the delayed digital primary sound signal.

36. The device of claim 35, wherein the processor is further configured for high-pass filtering the estimated impulse response if the error factor indicates a good signal-to-noise ratio for the estimated impulse response.

37. The device of claim 36, wherein the calculating of the delay comprises calculating the delay between the digitized acoustic signal and the digital primary sound signal by scanning the high-pass filtered, estimated impulse response to identify a peak magnitude of the high-pass filtered, estimated impulse response if the error factor indicates a good signal-to-noise ratio for the estimated impulse response.

38. A device for enhancing sound, the device comprising:

a microphone configured for sensing an acoustic signal, the acoustic signal emitted in response to a primary sound signal and transmitted through a space;

an analog-to-digital converter for converting the sensed acoustic signal to a digitized acoustic signal;

an antenna configured for receiving a wireless signal encoded with the primary sound signal;

a receiver for receiving and decoding the primary sound signal encoded in the wireless signal as a digital primary sound signal;

a processor configured for:

estimating an impulse response for the space based on the digitized acoustic signal and the digital primary sound signal;

calculating a transfer function from the estimated impulse response;

calculating an average group delay for the transfer function; and calculating a delay between the digitized acoustic signal and the digital primary sound signal by scanning the estimated impulse response to identify a peak magnitude of the estimated impulse response and comparing a time corresponding to the peak magnitude of the estimated impulse response to the average group delay for the transfer function;

a delay line configured for delaying the digital primary sound signal by the calculated delay if a difference between the time corresponding to the peak magnitude of the estimated impulse response and the average group delay is less than a predetermined value; and an output configured for outputting the delayed digital primary sound signal.

* * * * *